US009669420B2

(12) United States Patent
Heren et al.

(10) Patent No.: US 9,669,420 B2
(45) Date of Patent: Jun. 6, 2017

(54) WATER SPRINKLER

(71) Applicant: Fiskars Oyj Abp, Helsinki (FI)

(72) Inventors: Lawrence P. Heren, East Peoria, IL (US); Kalyan Vedantam, Peoria, IL (US)

(73) Assignee: Fiskars Oyj Abp, Helsinki (FI)

( * ) Notice: Subject to any disclaimer, the term of this patent is extended or adjusted under 35 U.S.C. 154(b) by 343 days.

(21) Appl. No.: 14/203,631

(22) Filed: Mar. 11, 2014

(65) Prior Publication Data

US 2014/0263732 A1 Sep. 18, 2014

Related U.S. Application Data

(60) Provisional application No. 61/793,263, filed on Mar. 15, 2013.

(51) Int. Cl.
*B05B 1/16* (2006.01)
*B05B 15/06* (2006.01)
(Continued)

(52) U.S. Cl.
CPC ..... *B05B 15/062* (2013.01); *B05B 1/169* (2013.01); *B05B 1/1654* (2013.01);
(Continued)

(58) Field of Classification Search
CPC ... B05B 1/1654; B05B 1/1672; B05B 15/062; B05B 1/1663; B05B 1/169; B05B 1/202;
(Continued)

(56) References Cited

U.S. PATENT DOCUMENTS 3,332,624 A * 7/1967 Rinkewich ..... B05B 1/1654 239/242
4,905,903 A * 3/1990 Katzer ..... B05B 3/06 239/246

(Continued)

FOREIGN PATENT DOCUMENTS

EP 0826427 A2 3/1998

OTHER PUBLICATIONS

International Preliminary Report on Patentability, PCT/US2014/024198, Robert Bosch GmbH, 8 pages (Sep. 15, 2015).

(Continued)

*Primary Examiner* — Arthur O Hall
*Assistant Examiner* — Juan C Barrera
(74) *Attorney, Agent, or Firm* — Foley & Lardner LLP

(57) ABSTRACT

A water sprinkler includes a base configured to rest on a surface, a barrel assembly, a primary fluid inlet, and a plurality of nozzle structures. The barrel assembly is rotatably supported by the base and defines a plurality of fluid channels, each fluid channel extending from a corresponding fluid inlet of a plurality of fluid inlets to a corresponding fluid outlet of a plurality of fluid outlets. The primary fluid inlet is supported by the base and is configured to be fluidly coupled to a selected fluid inlet by rotating the barrel assembly to a position that aligns the selected fluid inlet with the primary fluid inlet. The plurality of nozzle structures is supported by the barrel assembly. Each nozzle structure (i) is configured to sealingly engage at least one fluid outlet of the plurality of fluid outlets, and (ii) defines an outlet opening configured to emit a fluid flow.

20 Claims, 30 Drawing Sheets

(51) Int. Cl.
*B05B 1/20* (2006.01)
*B05B 1/26* (2006.01)
*B05B 9/01* (2006.01)

(52) U.S. Cl.
CPC ..... *B05B 1/1663* (2013.01); *B05B 1/1672* (2013.01); *B05B 1/202* (2013.01); *B05B 1/265* (2013.01); *B05B 1/267* (2013.01); *B05B 15/063* (2013.01); *B05B 15/064* (2013.01); *B05B 9/01* (2013.01)

(58) Field of Classification Search
CPC ..... B05B 1/265; B05B 1/267; B05B 15/063; B05B 15/064; B05B 9/01
USPC ..... 239/201, DIG. 1, 246, 562, 247, 258, 239/390, 391, 436, 451, 392, 393, 394, 239/548, 243, 249, 544, 553.5, 561, 587.1
See application file for complete search history.

(56) References Cited

U.S. PATENT DOCUMENTS 5,158,231 A 10/1992 Christen et al.
5,305,956 A 4/1994 Wang
5,307,993 A * 5/1994 Simonetti ..... B05B 3/06 239/247
5,350,115 A * 9/1994 Burnworth ..... B05B 3/044 239/242
5,645,218 A * 7/1997 Heren ..... B05B 1/3026 239/242
7,607,590 B2 * 10/2009 Nies ..... B05B 15/066 239/242
2006/0102751 A1 5/2006 Heren et al.
2006/0273202 A1 * 12/2006 Su ..... B05B 3/06 239/394
2007/0221756 A1 * 9/2007 Wang ..... B05B 1/1654 239/390
2012/0056014 A1 3/2012 Wang et al.

OTHER PUBLICATIONS

International Search Report and Written Opinion corresponding to PCT Application No. PCT/US2014/024198, mailed Jul. 14, 2014 (12 pages).

* cited by examiner

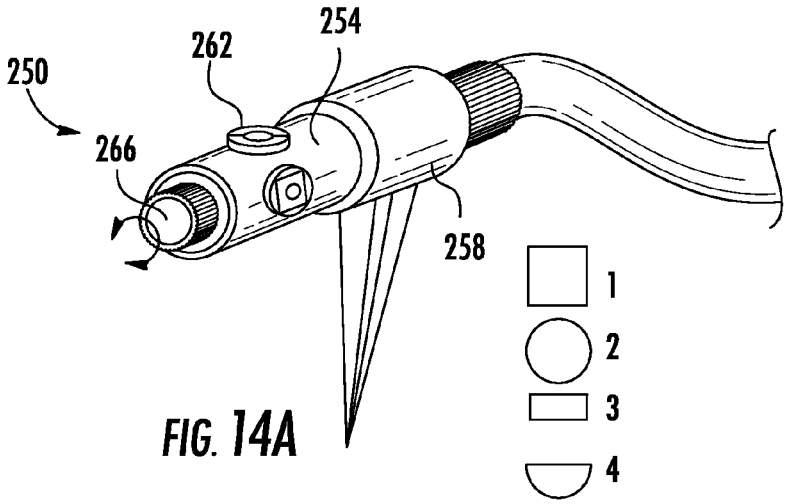
FIG. 14A
FIG. 14B
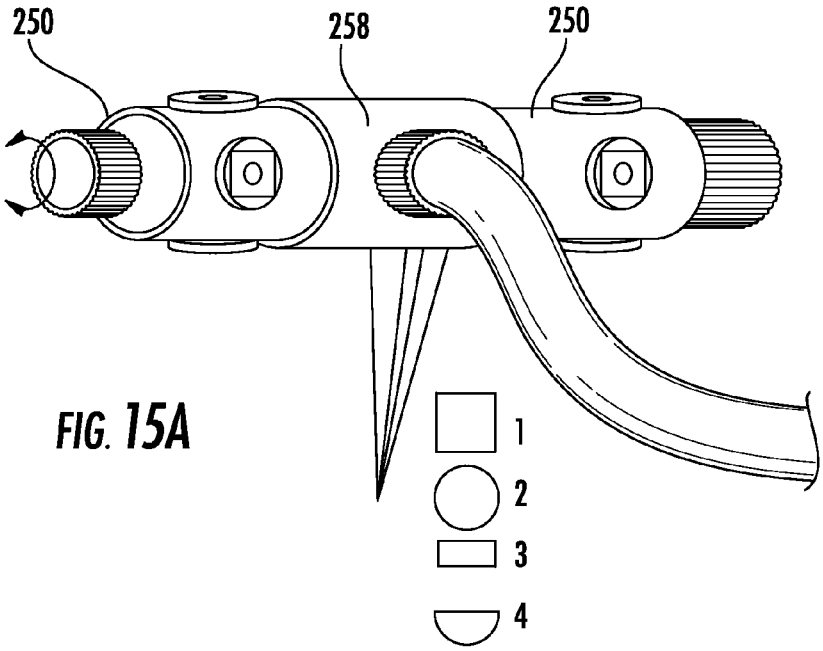
FIG. 15A
FIG. 15B

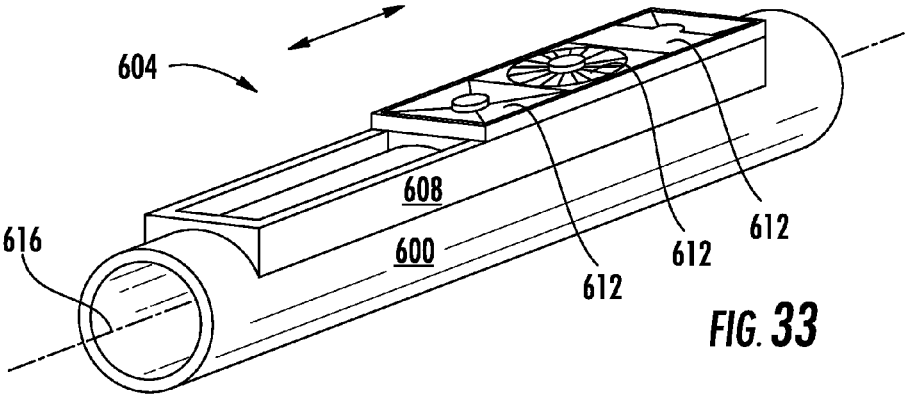
FIG. 33
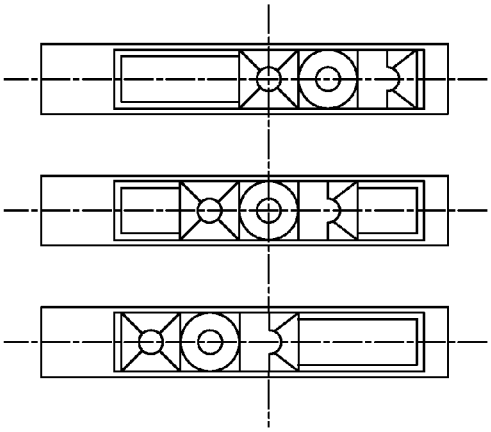
FIG. 34A
FIG. 34B
FIG. 34C
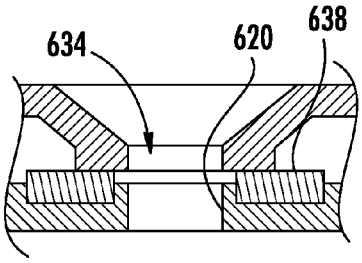
FIG. 35A
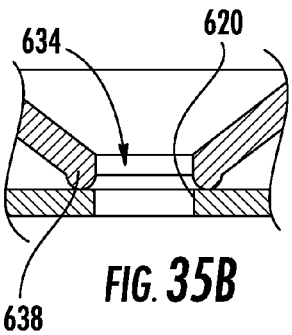
FIG. 35B
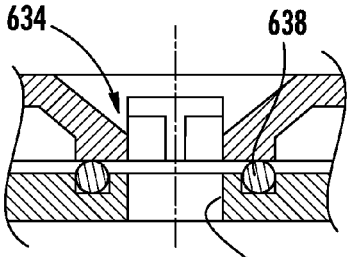
FIG. 35C

WATER SPRINKLER

This application claims the benefit of priority of U.S. provisional application Ser. No. 61/793,263, filed Mar. 15, 2013, the disclosure of which is herein incorporated by reference in its entirety.

FIELD

This disclosure relates generally to sprinklers for supplying water to lawns, flower beds, gardens and the like, and in particular to a sprinkler having a selectable spray pattern.

BACKGROUND

Sprinklers are typically used to supply water to lawns, flower beds, gardens, and other watering areas during periods of low rainfall. One common type of sprinkler is referred to as an oscillating sprinkler, which supplies water in a generally square-shaped watering pattern. Another common type of sprinkler is referred to as an impact sprinkler, which supplies water in a generally circular watering pattern or in an arc-shaped watering pattern. The oscillating sprinkler and the impact sprinkler work well to meet the needs of residents living in a rural or a suburban environment, since the size of the resultant watering pattern is typically appropriate for the size of the watering areas in these environments.

Some urban living residents also have watering needs. Urban environments are typically associated with closely spaced (or connected) homes and smaller lawns than are found in the typical suburban environment. In general, the urban environment presents more "watering obstacles" to the resident, such as cars passing on the street, pedestrians passing on the sidewalk, and the activity of the neighbors on their lawns and driveways, for example. Accordingly, urban residents desire a sprinkler that supplies water to a smaller watering area with improved accuracy over the typical oscillating sprinkler or impact sprinkler.

Therefore, it is desirable to provide a sprinkler that meets the needs of the urban resident.

SUMMARY

According to an exemplary embodiment of the disclosure, a water sprinkler includes a base configured to rest on a surface, a barrel assembly, a primary fluid inlet, and a plurality of nozzle structures. The barrel assembly is rotatably supported by the base and defines a plurality of fluid channels, each fluid channel extending from a corresponding fluid inlet of a plurality of fluid inlets to a corresponding fluid outlet of a plurality of fluid outlets. The primary fluid inlet is supported by the base and is configured to be fluidly coupled to a selected fluid inlet of the plurality of fluid inlets by rotating the barrel assembly to a position that aligns the selected fluid inlet with the primary fluid inlet. The plurality of nozzle structures is supported by the barrel assembly. Each nozzle structure (i) is configured to sealingly engage at least one fluid outlet of the plurality of fluid outlets, and (ii) defines an outlet opening configured to emit a fluid flow.

According to another exemplary embodiment of the disclosure, a water sprinkler includes a base configured to rest on a surface, a primary fluid inlet supported by the base, and a fill-in nozzle structure. The fill-in nozzle structure is configured to be fluidly coupled to the primary fluid inlet and defines (i) a first outlet opening configured to emit a first fluid flow a first maximum distance from the base, and (ii) a second outlet opening configured to emit a second fluid flow a second maximum distance from the base. The second maximum distance is less than or equal to one third of the first maximum distance.

According to yet another exemplary embodiment of the disclosure, a water sprinkler includes a base configured to rest on a surface, a primary fluid inlet supported by the base, and an angular coverage nozzle structure. The angular coverage nozzle structure is configured to be fluidly coupled to the primary fluid inlet and defines an outlet opening configured to emit a first fluid flow spanning an angle of coverage of 250° to 290°.

According to a further exemplary embodiment of the disclosure, a water sprinkler includes a base, a spray tube, and a nozzle assembly. The spray tube is supported by the base and defines a fluid inlet and a fluid outlet. The nozzle assembly is slidingly supported on the spray tube and defines at least a first fluid nozzle and a second fluid nozzle. The nozzle assembly is slidable relative to the spray tube to position a selected one of the nozzles in sealing engagement with the fluid outlet.

According to a still further exemplary embodiment of the disclosure, a water sprinkler includes a positioning structure and a water sprinkler. The positioning structure includes an anchoring element and defines a socket. The anchoring element is configured to anchor the positioning structure in the ground. The water sprinkler includes a fluid delivery assembly and a positioning fitting. The positioning fitting is configured to releasably engage the socket to thereby anchor the water sprinkler.

BRIEF DESCRIPTION OF THE FIGURES

The following detailed description references the accompanying figures in which:

FIG. 14A is a perspective view of another embodiment of a water sprinkler, which is connected to a positioning structure;

FIG. 14B illustrates four exemplary spray patterns formed by the water sprinkler of FIG. 14A;

FIG. 15A is a perspective view of another embodiment of a water sprinkler, which includes two water emitting portions;

FIG. 15B illustrates four exemplary spray patterns formed by the water sprinkler of FIG. 15A;

FIG. 33 is another perspective view of the spray tube and the sliding water pattern assembly of FIG. 32;

FIG. 34*a* is top plan view of the spray tube and the sliding water pattern assembly of FIG. 32 with a nozzle block of the sliding water pattern assembly shown in a first position;

FIG. 34*b* is top plan view of the spray tube and the sliding water pattern assembly of FIG. 32 with a nozzle block of the sliding water pattern assembly shown in a second position;

FIG. 34*c* is top plan view of the spray tube and the sliding water pattern assembly of FIG. 32 with a nozzle block of the sliding water pattern assembly shown in a third position;

FIG. 35*a* is a cross sectional view of the spray tube and the sliding water pattern assembly of FIG. 32 showing an exemplary seal solution between the spray tube and the nozzle block;

FIG. 35*b* is a cross sectional view of the spray tube and the sliding water pattern assembly of FIG. 32 showing another exemplary seal solution between the spray tube and the nozzle block;

FIG. 35*c* is a cross sectional view of the spray tube and the sliding water pattern assembly of FIG. 32 showing yet another exemplary seal solution between the spray tube and the nozzle block;

DETAILED DESCRIPTION

Figure 1:
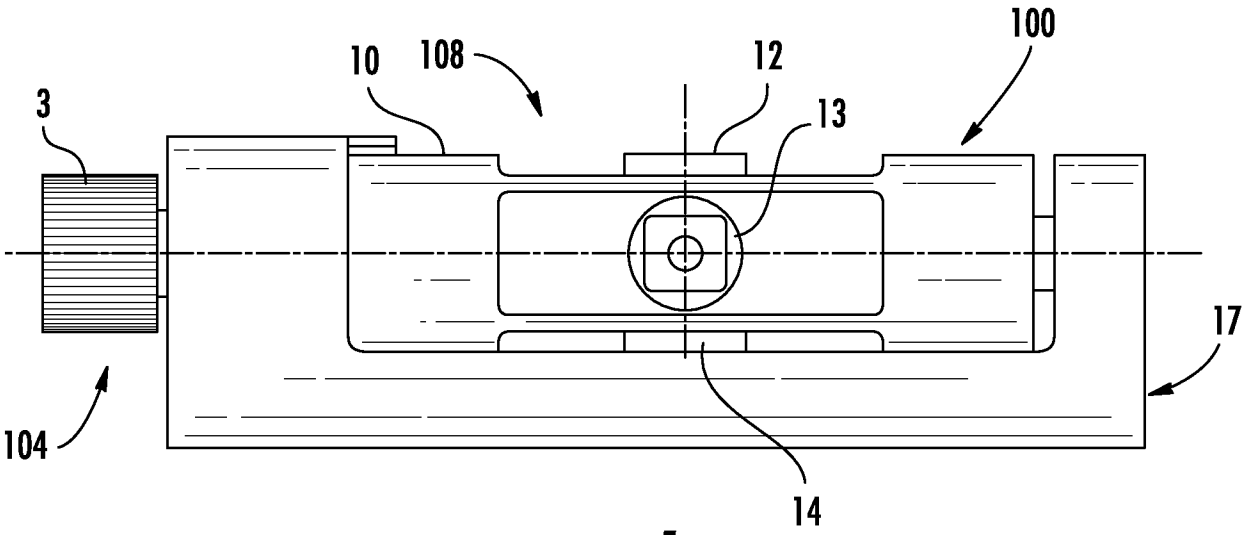
FIG. 1 is a side elevational view of a water sprinkler having a rotatable barrel, as described herein.

For the purpose of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one skilled in the art to which this disclosure pertains.

A. Water Sprinkler having a Rotatable Barrel for Selecting a Spray Pattern

Figure 2:
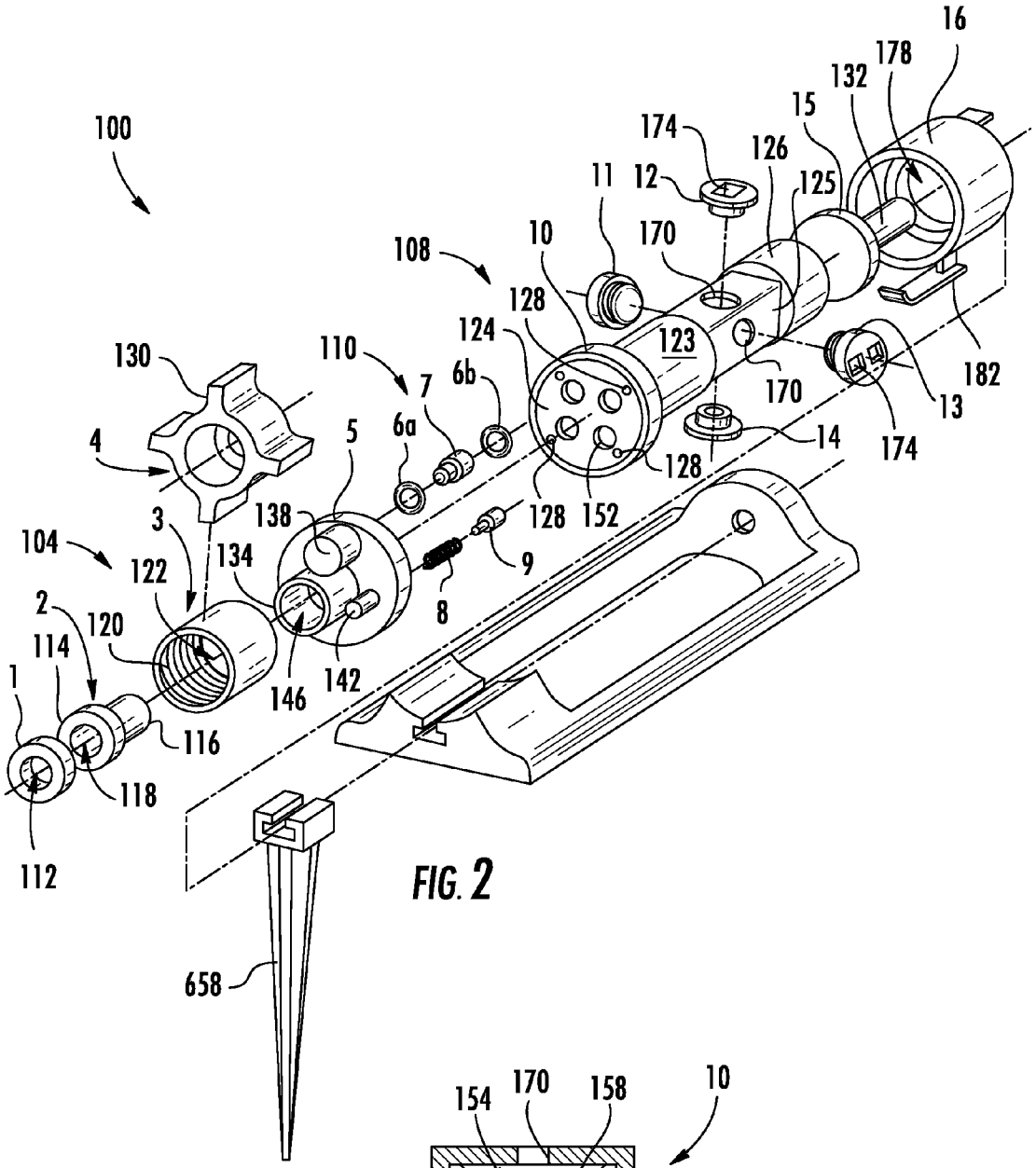
FIG. 2 is an exploded perspective view of the water sprinkler of FIG. 1.

As shown in FIGS. 1 and 2, a sprinkler 100 includes a water connection assembly 104, a barrel assembly 108, and a base 17 (FIG. 1) configured to rest on a surface, such as the ground or any other surface. With reference to FIG. 2, the water connection assembly 104 includes a hose washer 1, a shank 2, a coupling nut 3, and a retainer plate assembly 110. The hose washer 1 is an elastomeric washer that defines an opening 112 configured to enable water to flow therethrough. The hose washer 1 is further configured to be seated against a connection fitting of a garden hose (not shown). The term "garden hose," as used herein, includes any type of water supply line that is suitable for connection to the sprinkler 100.

The shank 2 includes a shoulder 114 and a tube 116 and defines an opening 118 therethrough. The shoulder 114 is positioned against the hose washer 1. The tube 116 has a narrower outside diameter than an outside diameter of the shoulder 114. The shank 2 is formed from injection molded thermoplastic or any other material as desired by those of ordinary skill in the art.

The coupling nut 3 defines a threaded interior 120 and a primary fluid inlet 122 therethrough. The primary fluid inlet 122 is supported by the base 17. The threaded interior 120 is configured to connect the coupling nut 3 to the connection fitting of the garden hose. The hose washer 1 and the shoulder 114 are at least partially positioned within the coupling nut 3. The tube 116 of the shank 2 extends through the primary fluid inlet 122. An alternative embodiment of the coupling nut 4 is also shown in FIG. 2. The coupling nut 4 is a metal nut including a plastic over-mold 130.

Figure 5:
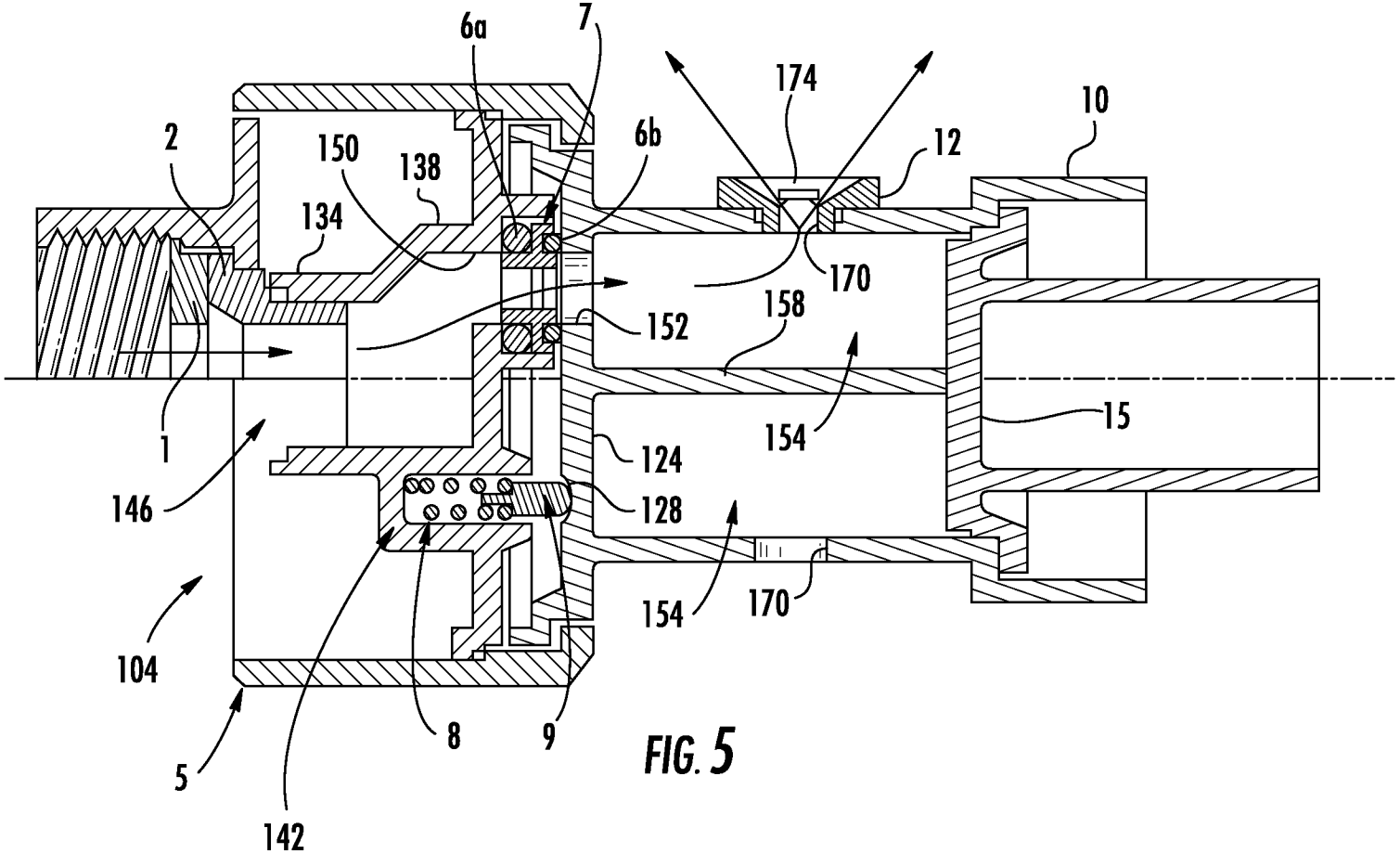
FIG. 5 is a cross sectional view of a water connection assembly and a portion of the barrel assembly of the water sprinkler of FIG. 1.

The retainer plate assembly 110 includes a retainer plate 5 defining an inlet tube 134, a seal recess 138, and a detent recess 142. The inlet tube 134 defines an opening 146 that is in fluid communication with the opening 118 in the shank 2. The inlet tube 134 is terminated with an outlet opening 150 (FIG. 5). The tube portion 116 of the shank 2 is connected to the inlet tube 134 by a sonic weld, glue, or any other suitable connection method as desired by those of ordinary skill in the art.

The retainer plate assembly 110 further includes an o-ring **6*a*, a seal cup 7, and an o-ring 6*b*, which are at least partially positioned in the seal recess 138. The o-ring 6*a*, the seal cup 7, and the o-ring 6*b*, are configured to form a generally water tight connection between the retainer plate 110 and the barrel assembly 108** (as described in detail below).

The retainer plate assembly 110 also includes a spring 8 and a detent button 9, which are positioned in the detent recess 142. The detent button 9 is configured to be biased into contact with a selected detent seat 128 (FIG. 5) of a plurality of detent seats defined by the faceplate 124 to releasably maintain the barrel assembly 108 in a selected rotational position.

With continued reference to FIG. 2, the barrel assembly 108, includes a faceplate 124, a spray tube 10, a closure plate 15, and four patterned nozzle structures 11, 12, 13, 14, which are supported by the barrel assembly 108 and which are also referred to herein as "pattern plates." The faceplate 124 is a generally circular plate that defines four circular fluid inlets 152 therethrough. The faceplate 124 is connected to the spray tube 10. The primary fluid input 122 is fluidly coupled to the selected fluid inlet 152 when the detent button 9 is biased into the selected detent seat 128.

The spray tube 10 includes a cylindrical portion 123, a quadrilateral portion 125, and another cylindrical portion 126. The portions 123, 125, 126 are integrally formed as a monolithic part or an assembly of any combination of the portions 123, 125, 126. The spray tube 10 is formed form injection molded thermoplastic or any other material, as desired by those of ordinary skill in the art. In another embodiment, the entire spray tube 10 is generally cylindrical.

Figure 3:
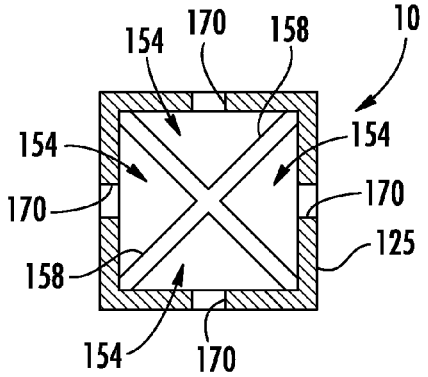
FIG. 3 is a cross sectional view of a spray tube portion of the water sprinkler of FIG. 1.

As shown in FIG. 3, the spray tube 10 defines a plurality of fluid channels 154. The fluid channels 154 extend at least from a corresponding one of the fluid inlets 152 to a corresponding one of a plurality of fluid outlets 170. The fluid channels 154 are isolated from each other by ribs 158 positioned within the spray tube 10. Each of the fluid channels 154 is aligned with one of the fluid inlets 152 through the faceplate 124. In another embodiment, the spray tube 10 has any number of fluid channels 154 and fluid outlet 170, including multiple fluid outlets 170 associated with the same fluid channel 154. For example, the spray tube 10 has between one to ten fluid channels 154 and between one to ten associated fluid outlets 170. The primary fluid inlet 122 is configured to be fluidly coupled to a selected fluid inlet 152 by rotating the barrel assembly 108 to a position that aligns the selected fluid inlet 152 with the primary fluid inlet 122.

Figure 4:
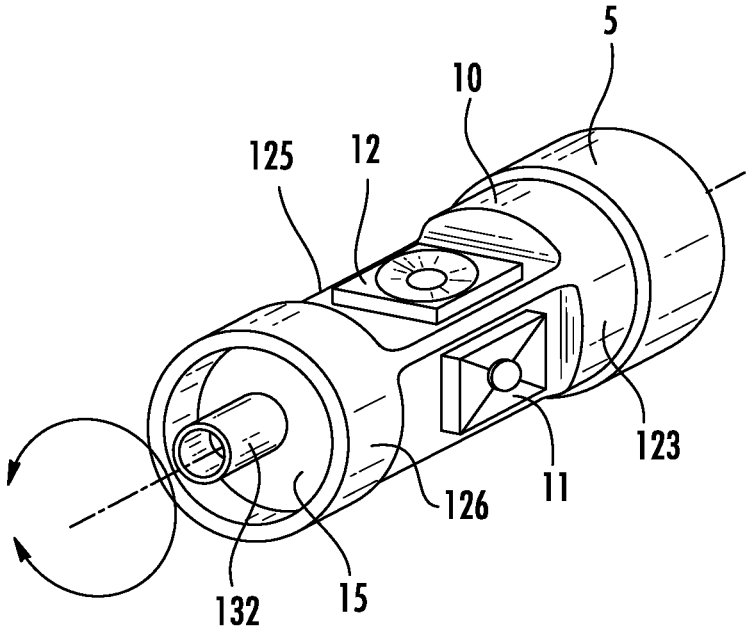
FIG. 4 is a perspective view of a barrel assembly of the water sprinkler of FIG. 1.

With reference to FIG. 4, the closure plate 15, which is also referred to herein as an end cap, is connected to the spray tube 10 with a sonic weld, glue, or any other connection as desired by those of ordinary skill in the art. The closure plate 15 is an imperforate plate that closes or caps the fluid channels 154 defined by the spray tube 10. The closure plate 15 includes an extension shaft 132 that, in some embodiments, is configured to be connected to the base 17 of the sprinkler 100. In some embodiments, the extension shaft 132 is usable as a knob to rotate the barrel assembly 108.

As shown in FIG. 2, the nozzle structures 11, 12, 13, 14 are connected to the spray tube 10 with a sonic weld, glue, or any other connection as desired by those ordinary skill in the art. Each nozzle structure 11, 12, 13, 14 covers one of the fluid outlets 170 in the spray tube 10, such that each nozzle structure is configured to sealingly engage at least one of the fluid outlet 170. Each nozzle structure 11, 12, 13, 14 defines at least one outlet opening passage 174 that is fluidly connected to one of the fluid channels 154 and that is configured to emit a fluid flow.

A body 16 of the sprinkler 100 is located near the closure plate 15 of the spray tube 10. The body 16 defines a cavity 178 in which at least a portion of the closure plate 15 is positioned. The body 16 includes a snap leg 182 that connects the body 16 and the spray tube 10 to the base 17.

With reference again to FIG. 1, the base 17 is a full base that is connected to the water connection assembly 104 and to the body 16 (not shown in FIG. 1). The base 17 is formed from injection molded thermoplastic, cast from metal, or formed from any other material as desired by those of ordinary skill in the art. The base 17 is configured to rotatably support the barrel assembly 108 in a manner that enables the spray tube 10 to be rotated relative to the base (as described below in detail) about a longitudinal axis 616 (FIG. 33). An alternative embodiment of the base, referred to as a short base 186 is also shown in FIG. 2.

Figure 6:
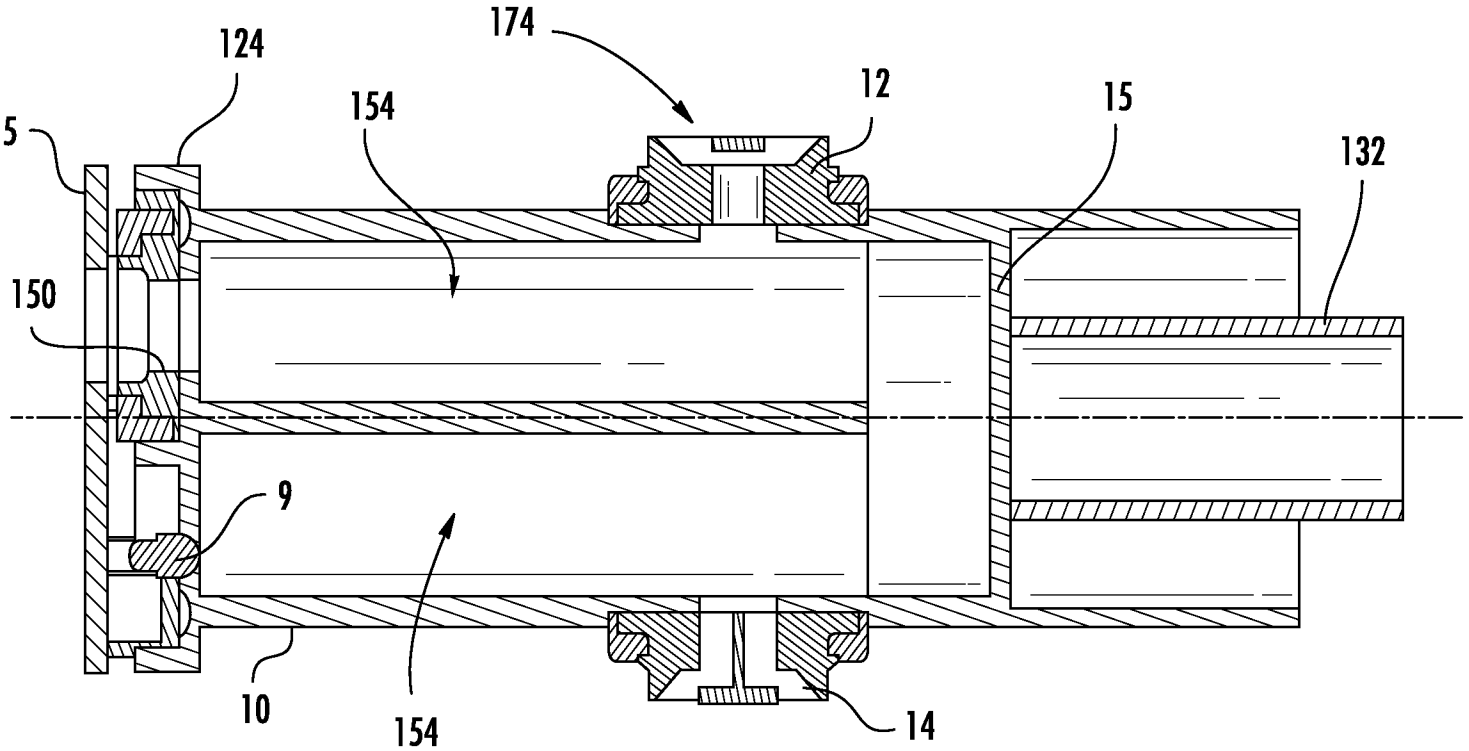
FIG. 6 is another cross sectional view of a portion of the water connection assembly and the barrel assembly of the water sprinkler of FIG. 1.

As shown in FIGS. 5 and 6, in operation, the sprinkler 100 emits water from one of the nozzle structures (nozzle structure 12 as shown in FIGS. 5 and 6) to supply water to an area to be irrigated. To prepare the sprinkler 100 for irrigation, first the user selects a desired one of the nozzle structures 11, 12, 13, 14. Then the user rotates the barrel assembly 108 relative to the water connection assembly 104 and the base 17, so that the desired nozzle structure 12 is facing away from the base 17.

As the user rotates the barrel assembly 108 to select one of the nozzle structures 11, 12, 13, 14, the fluid inlets 152 are moved relative to the retainer plate 5. When one of inlets 152 is aligned with the outlet opening 150, that inlet 152 and its associated fluid channel 154 are fluidly coupled to the inlet tube 134 and are configured to receive water from the water source through the primary fluid inlet 122. In the embodiment of FIGS. 5 and 6, only one of the fluid channels 154 is configured to be coupled to the water source at a time. Accordingly, no other fluid channel 154 receives water from the water source except for the fluid channel 154 that is aligned with the outlet opening 150.

As the barrel assembly 108 is rotated, the detent button 9 periodically engages one of a plurality of detent seats 128 (FIG. 5, only one shown, see also FIG. 2 four of the detent seats 128 are shown) formed in the faceplate 124. The detent button 9 engages one of the detent seats 128 when the one of the inlets 152 is aligned with the outlet opening 150. When the detent button 9 engages one of the detent seats 128, a vibration or an audible noise is made as the detent spring 8 biases the detent button 9 against the faceplate 124. The vibration or audible noise indicates to the user that one of the nozzle structures 11, 12, 13, 14 is in a position to be supplied with water. Accordingly, the barrel assembly 108 is positively engaged in each of the four positions (in the embodiment of FIGS. 5 and 6) in which a nozzle structure 11, 12, 13, 14 is configured to be supplied with water.

The o-ring 6*a*, the seal cup 7, and the o-ring 6*b* form a water tight seal between the retainer plate 5 and the faceplate 124. The water tight seal prevents water from exiting the outlet opening 150 and leaking from between the retainer plate 5 and the faceplate 124.

Next, the user connects the coupling nut 3 to the garden hose. Thereafter, the user supplies the sprinkler 100 with water from the garden hose. As shown in FIG. 5, the water flows through shank 2 and the primary fluid inlet 122 of the coupling nut 3 and then enters the retainer plate 5 though the opening 146 in the inlet tube 134. Then, the water flows out the retainer plate 5 through the outlet opening 150 and into one of the fluid channels 154 through one of the inlet 152. The water exits the fluid channel 154 through the fluid outlet 170 and flows from the nozzle structure 12 through the passage 174.

During operation of the sprinkler 100 the barrel assembly 108 remains stationary relative to the water connection assembly 104 and the base 17. Accordingly, the barrel assembly 108 does not rotate or oscillate. This enables a user to precisely position the stream of water flowing from the sprinkler 100 onto a particular well-defined area, as is useful in an urban environment.

If the user desires to select a different spray pattern, first the water from the garden hose is stopped. Second, the user rotates the barrel assembly 108 until another one of the nozzle structures 11, 12, 13, 14 and its associated fluid channel 154 are aligned to receive water from the outlet opening 150. In this way, a desired spray pattern is easily selectable by the user.

Figure 7:
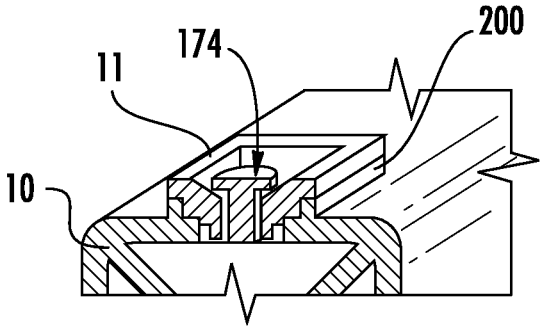
FIG. 7 is a cross sectional view of a spray tube and a nozzle structure for use with at least the water sprinkler of FIG. 1.

As shown in FIGS. 7-11, the nozzle structure 11 (and various embodiments thereof) is shown mounted to the spray tube 10 (and various embodiments thereof). With reference to FIG. 7, the spray tube 10 includes a raised ridge 200 on which the nozzle structure 11 is seated. The nozzle structure 11 is configured to be sonically welded to the raised ridge 200. Alternatively, the nozzle structure 11 is glued or any other connection method is used, as desired by those of ordinary skill in the art, to connect the nozzle structure to the raised ridge 200.

Figure 8:
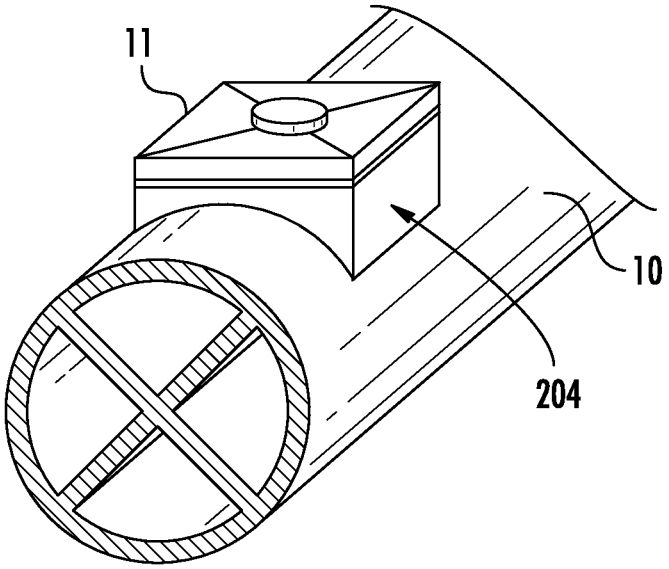
FIG. 8 is a perspective view of a spray tube and a nozzle structure for use with at least the water sprinkler of FIG. 1.

As shown in FIG. 8, the spray tube 10 includes a raised structure 204 on which the nozzle structure 11 is seated. The nozzle structure 11 is configured to be sonically welded to the raised structure 204. Alternatively, the nozzle structure 11 is glued to the raised structure 204.

Figure 9:
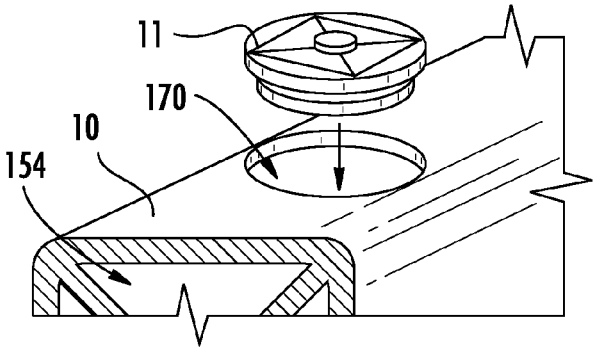
FIG. 9 is a perspective view of a spray tube and a nozzle structure for use with at least the water sprinkler of FIG. 1.

As shown in FIG. 9, the nozzle structure 11 and the fluid outlet 170 define a circular periphery. In this embodiment the nozzle structure 11 is structured to be spin welded to the spray tube 10. To spin weld the nozzle structure 11, the nozzle structure 11 is gripped and spun while being pushed into the fluid outlet 170. The resultant friction partially melts the nozzle structure 11 and the spray tube 10. Upon cooling the nozzle structure 11 and the spray tube 10 are welded together.

Figure 10:
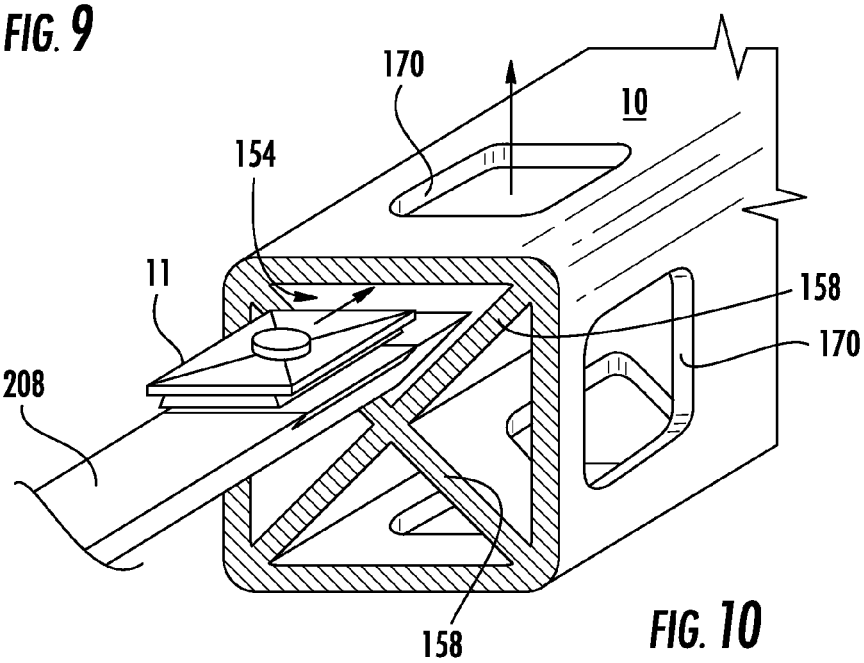
FIG. 10 is a perspective view of a spray tube and a nozzle structure having seal beads for use with at least the water sprinkler of FIG. 1, also shown is a mandrel configured to connect the nozzle structure to the spray tube.

With reference to FIG. 10, the nozzle structure 11 is connected to the spray tube 10 by being inserted into the fluid channel 154 and then being pressed into the fluid outlet 170 from within the fluid channel 154 by a mandrel 208. Accordingly, the nozzle structure 11 is formed from a resilient material that is deformable to fit through the fluid outlet 170 and then returns to shape thereafter. To connect the next nozzle structure 11 the spray tube 10 is rotated to match the water passage segment and then another nozzle structure is inserted into the next fluid channel 154.

Figure 11:
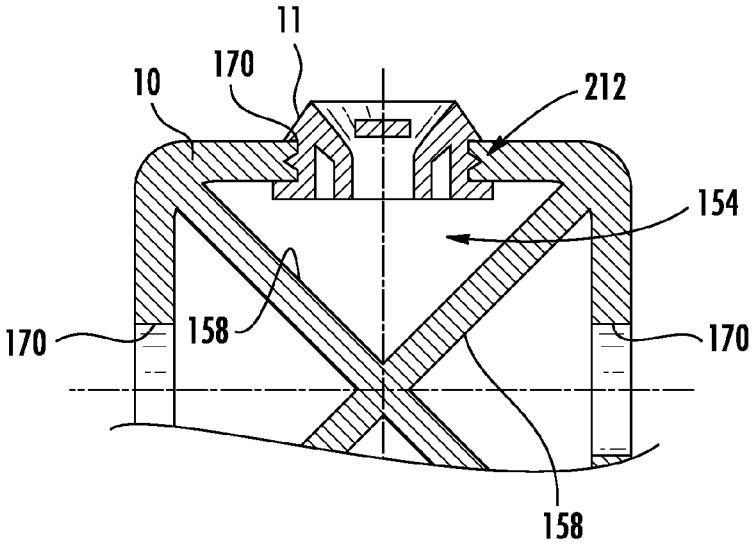
FIG. 11 is a cross sectional view of the spray tube and the nozzle structure shown in FIG. 10 after the nozzle structure has been sealed to the spray tube.

As shown in FIG. 11, the nozzle structure 11 of FIG. 10 includes a perimeter seal bead 212 that forms a water tight seal between the nozzle structure and the spray tube 10. Accordingly, no welding or glue is required to connect the nozzle structure 11 to the spray tube 10; nonetheless, welding and/or glue is usable to further seal the nozzle structure 11 and the spray tube 10.

Figure 12A:
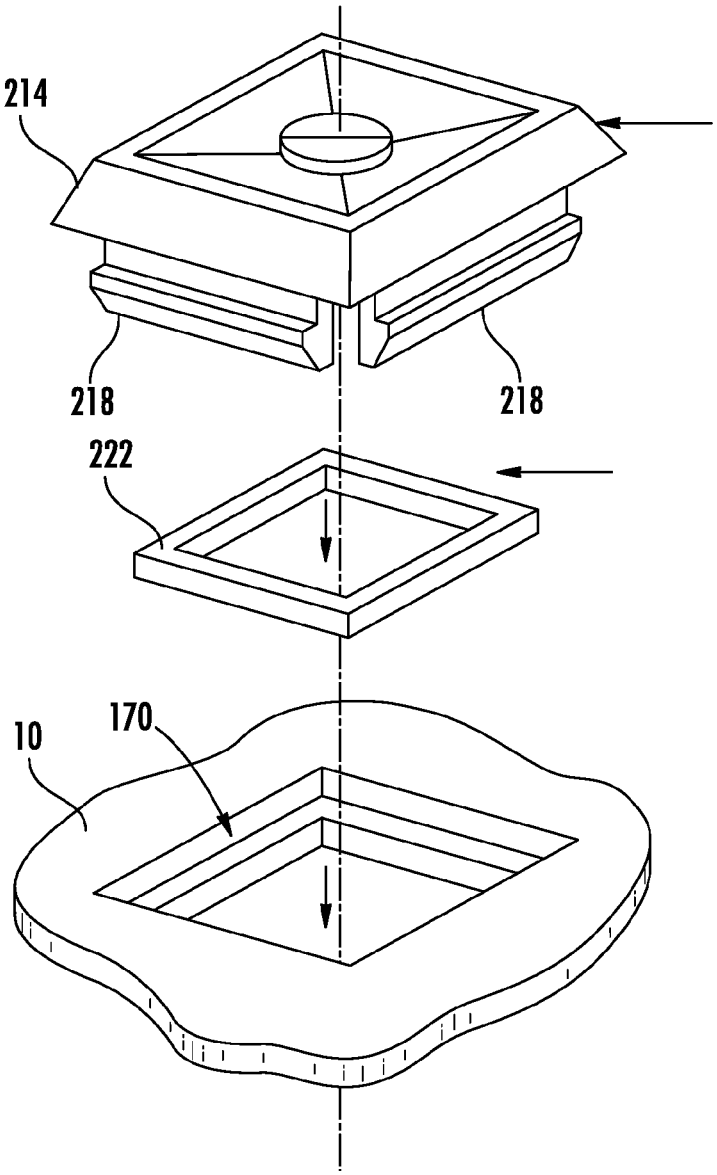
FIG. 12*a* is an exploded view of a portion of a spray tube, a seal, and a nozzle structure for use with at least the water sprinkler of FIG. 1.
Figure 12B:
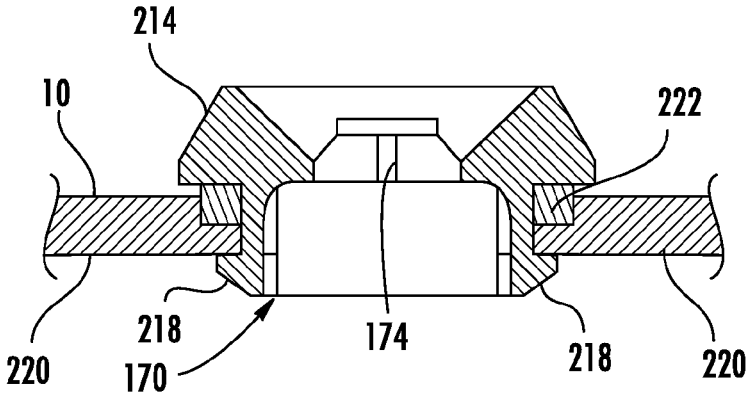
FIG. 12*b* is a cross sectional view of the spray tube and the nozzle structure of FIG. 12*a;*

In FIGS. 12*a* and 12*b*, a nozzle structure 214 includes four resilient latching members 218 (two of which are shown). The latching members 218 grip an interior side 220 of the spray tube 10 to connect the nozzle structure 214 to the spray tube 10. A rubber seal 222 forms a water tight seal between the nozzle structure 214 and the spray tube 10. The nozzle structure 214 is configured to compress the rubber seal 222 when the nozzle structure 214 is connected to the spray tube 10. The compression of the rubber seal 222 fills any voids between the nozzle structure 214 and the spray tube 10 so that the water tight seal is formed. In another embodiment, the nozzle structure 214 includes any number of resilient latching members 218.

Figure 13:
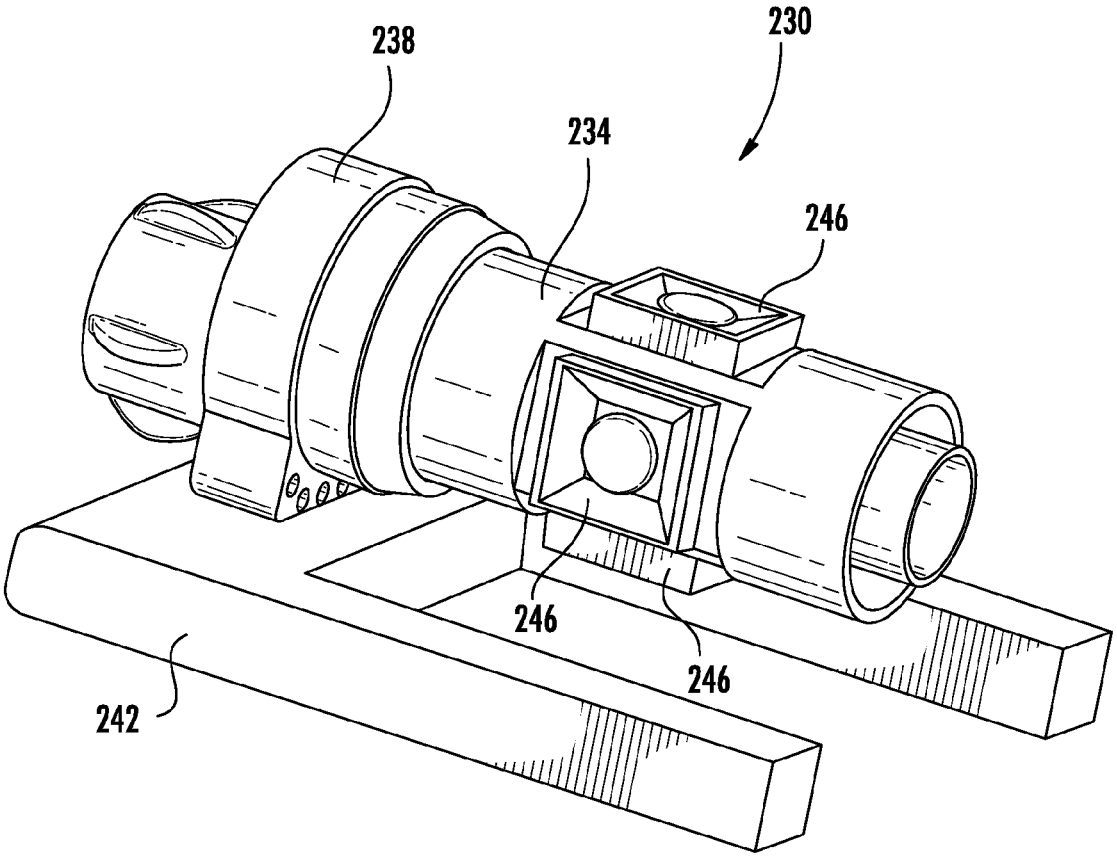
FIG. 13 is a perspective view of another embodiment of a water sprinkler, which includes a short base.
Figure 16:
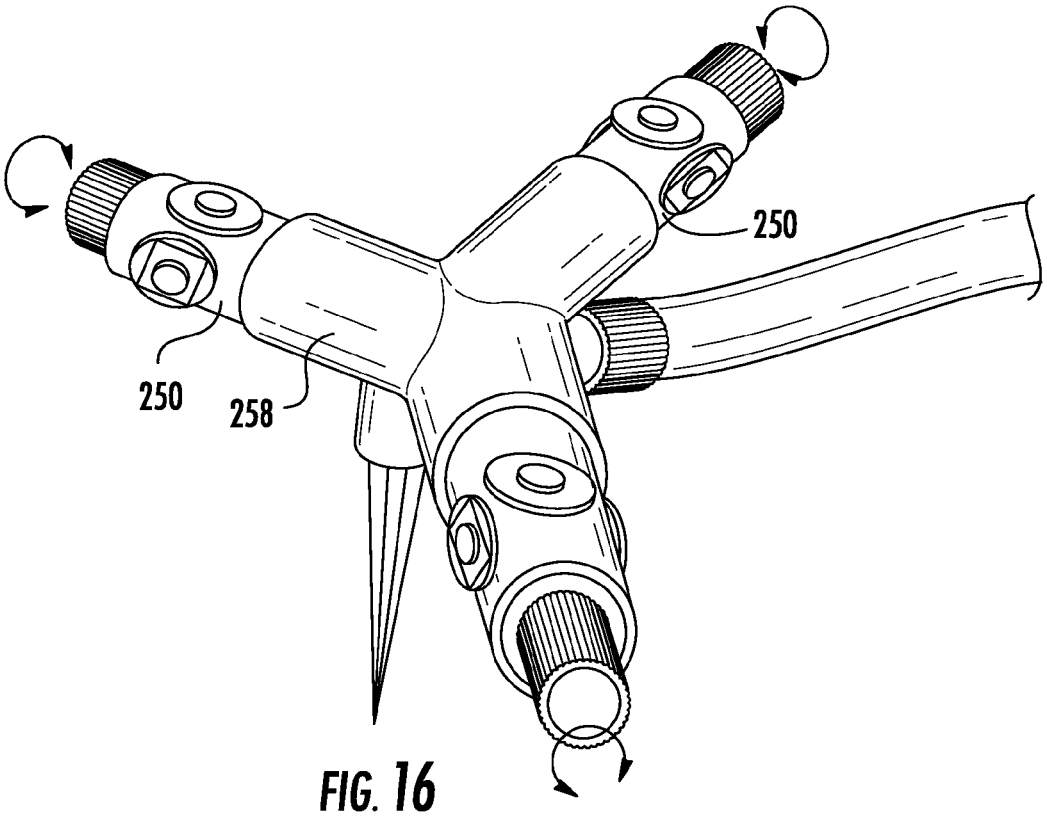
FIG. 16 is a perspective view of another embodiment of a water sprinkler, which includes three water emitting portions.

Another embodiment of a sprinkler 230 is shown in FIG. 13. The sprinkler 230 includes a fluid delivery assembly including a barrel assembly 234 and a water connection assembly 238. The barrel assembly 234 includes four nozzle structures 246 (three of which are shown) and is rotatably mounted to the water connection assembly 238. The water connection assembly 238 is connected to a base 242.

The sprinkler 230 operates the same as sprinkler 100 to enable the user to rotate the barrel assembly 234 and to select a desired one of the nozzle structures 246. Water is emitted from at least one of the nozzle structures 246 during operation of the sprinkler 230.

As shown in FIG. 14A another embodiment of a sprinkler 250 includes a barrel assembly 254 that is rotatably mounted to a water connection assembly 258. The barrel assembly 254 includes four nozzle structures 262 only two of which are shown. The sprinkler 250 includes a knob 266 connected to the barrel assembly 254. The knob 266 is "grip-able" by a user to rotate the barrel assembly easily, even when the knob 266 is wet.

The sprinkler 250 operates the same as sprinkler 100 to enable the user to rotate the barrel assembly 254 and to select a desired one of the nozzle structures 262. Exemplary water patterns are shown as patterns 1-4 in FIG. 14B. Water is emitted from at least one of the selected nozzle structures 262 during operation of the sprinkler 250.

Figure 17:
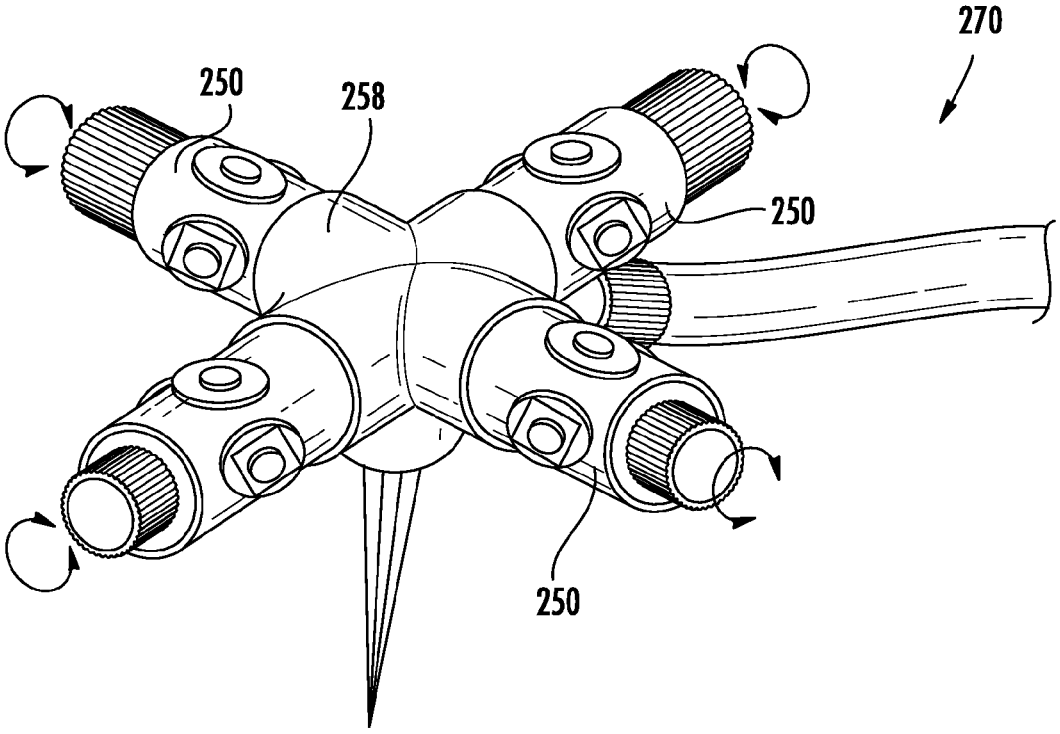
FIG. 17 is a perspective view of another embodiment of a water sprinkler, which includes four water emitting portions.

As shown in FIGS. 15A, 15B, 16, and 17, any number of sprinklers 250 are connectable to the water connection assembly 258, thereby enabling two hundred fifty six water pattern combinations to be made with the sprinkler assembly 270, shown in FIG. 17 (to arrive at two hundred fifty six water pattern combinations, water is configured to be sprayed from one nozzle structure 262 of each sprinkler 250). Exemplary water patterns are shown as patterns 1-4 in FIG. 15B.

In addition to being positionable on the ground surface, each of the above-described sprinklers 100, 230, 250, 270 is compatible with in-ground irrigation systems that are positioned at least partially below the ground surface. In the typical in-ground irrigation system, a sprinkler assembly is connected to a fluid source by a buried conduit. When not in use, the entire sprinkler assembly is located near or below the ground surface so as to be unobtrusive to activities occurring on the ground surface. When in use, however, water pressure from the fluid source causes a sprinkler head of the sprinkler assembly to automatically "pop up" above the ground surface so that water is effectively broadcast on the ground surface. Typically, the sprinkler head pops up approximately two to eight inches above the ground surface in order to enable the water emitted by the sprinkler head to flow over any vegetation planted near the sprinkler assembly. When watering is complete, a biasing member of the sprinkler assembly causes the sprinkler head to automatically return to the below ground surface position.

The sprinklers 100, 230, 250, 270 are usable with in-ground irrigation systems. For example, in one embodiment the sprinkler 100, 230, 250, 270 is included in the sprinkler head of the above-described in-ground sprinkler assembly. Accordingly, the sprinkler 100, 230, 250, 270 is configured to move relative to the ground surface between a pop-up position and a retracted position. In the pop-up position the sprinkler 100, 230, 250, 270 is positioned to deliver water to a watering area, and in the retracted position the sprinkler is positioned at or below the ground surface. In such an embodiment, the sprinkler assembly includes a spike such as the spike 658 of FIG. 2, which is configured to anchor the sprinkler assembly in the ground.

B. Collar Structure for Water Sprinkler

Figure 18:
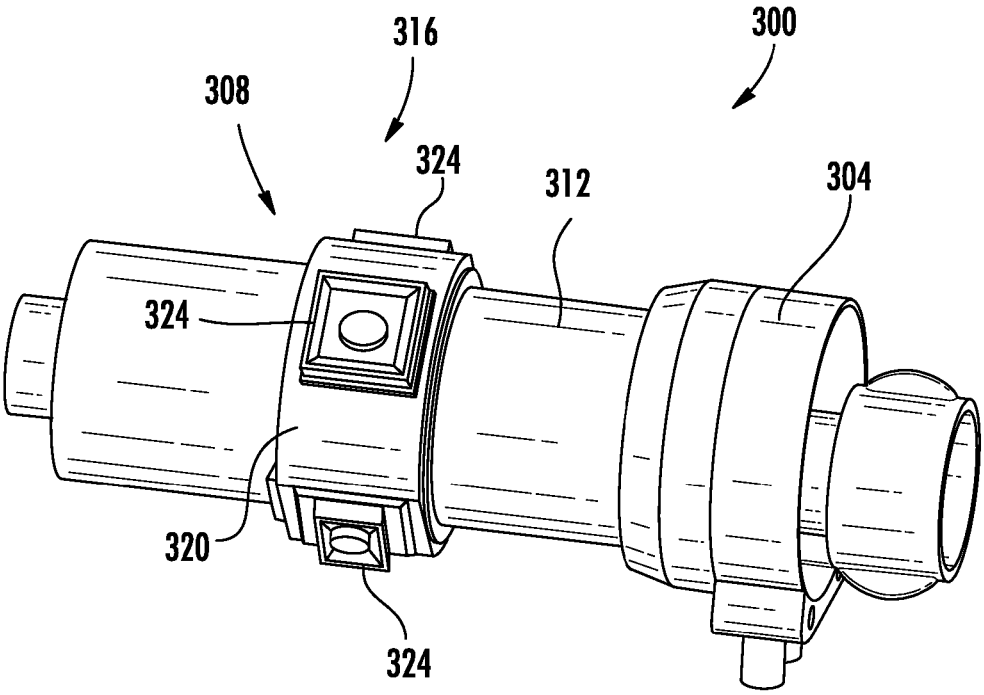
FIG. 18 is a perspective view of another embodiment of a water sprinkler, which includes a collar structure.

As shown in FIG. 18, a water sprinkler 300 includes a water connection assembly 304 and a barrel assembly 308. The barrel assembly 308 is configured for rotation relative to the water connection assembly 304. The barrel assembly 308 includes a spray tube 312 and a collar structure 316.

Figure 19:
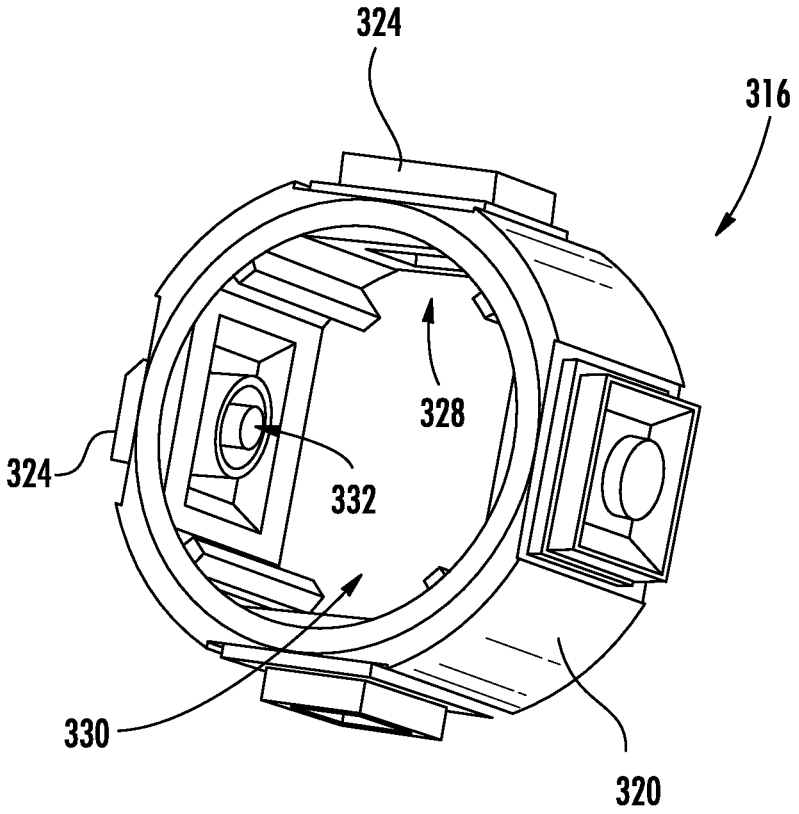
FIG. 19 is a perspective view of the collar structure of FIG. 18.

As shown in FIG. 19, the collar structure 316 is supported by the barrel assembly 308 and defines an axial opening 330 and a plurality of radial nozzle openings 332, 328. The barrel assembly 308 extends through the axial opening 330. The nozzle structures 324 are mounted in the nozzle openings 332, 328 and are connected to the collar structure 316 by any connection method as desired by those of ordinary skill in the art, such as sonic welding and glue.

Figure 20:
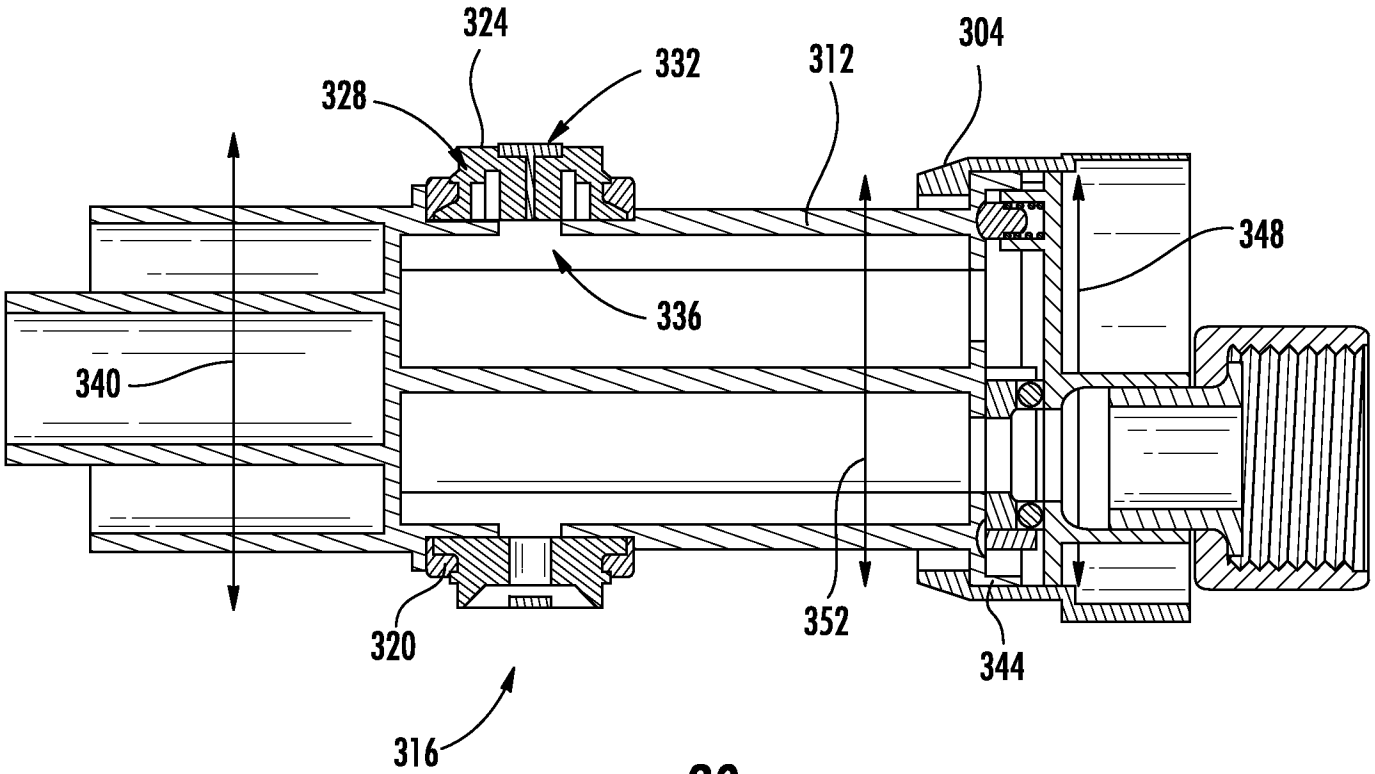
FIG. 20 is a cross sectional view of the water sprinkler of FIG. 18.

With reference to FIG. 20, the collar structure 316 is shown fixedly connected to the spray tube 312. The collar structure 316 is connected to the spray tube 312 by any connection method as desired by those of ordinary skill in the art, such as sonic welding and glue. The collar structure 316 is connected to the spray tube 312 in a position that aligns the nozzle openings 332 and the nozzle structures 324 with the fluid outlets 336 in the spray tube 312.

The collar structure 316 simplifies assembly of the water sprinkler 300. The collar structure 316 defines a diameter 340 and the spray tube 312 includes a flange 344 that defines a diameter 348. Additionally, the water connection assembly 304 defines an inside diameter 352. Both the diameter 340 of the collar structure 316 and the diameter 348 of the flange 344 are greater than the inside diameter 352 defined by the water connection assembly 204. Accordingly, the water sprinkler 300 is assembled by inserting the spray tube 312 through the water connection structure 304 until the flange 344 is seated against the water connection assembly 304. Then collar structure 316 is slid over the end of the spray tube 312 opposite the flange 344. This design prevents the issue of having to pass the nozzle structures 324 and the ring 320 through the water connection structure 304.

In another embodiment, the barrel assembly 308 and the spray tube 312 are fixed relative to the water connection assembly 304. In this embodiment, the collar structure 316 is rotatable around the spray tube 312. Also in this embodiment, the spray tube 312 has only one water passage and does not include indexing elements.

Figure 21:
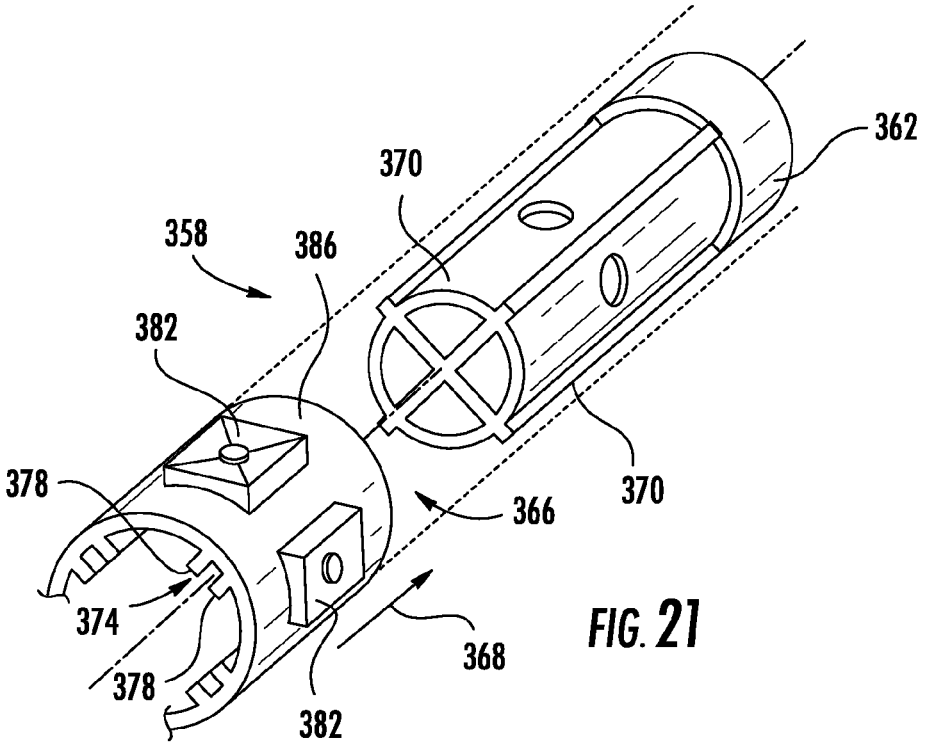
FIG. 21 is a perspective view of another embodiment of a spray tube and a collar structure for use with at least the water sprinkler of FIG. 18, the collar structure is shown partially cut away.

As shown in FIG. 21, another embodiment of the barrel assembly 358 includes a spray tube 362 and a collar structure 366. The spray tube 362 is an elongated cylinder extending in a longitudinal direction 368 and is configured to define longitudinal ridges 370 that are configured to mate with longitudinal recesses 374 defined by recess structures 378 of the collar structure 366 to prevent rotation of the collar structure relative to the spray tube of the barrel assembly 358. In this embodiment, a bottom surface (not shown) of the rubber nozzle structures 382 forms a seal against the spray tube 362. Also, in at least one embodiment, the rubber nozzle structures 382 and the ring 386 of the collar structure 366 are integrally formed as a monolithic part.

Figure 22:
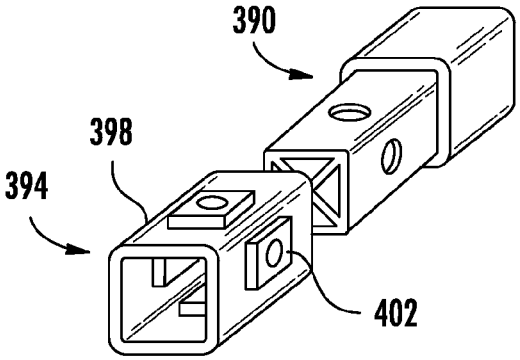
FIG. 22 is a perspective view of another embodiment of a spray tube and a collar structure for use with at least the water sprinkler of FIG. 18.
Figure 23:
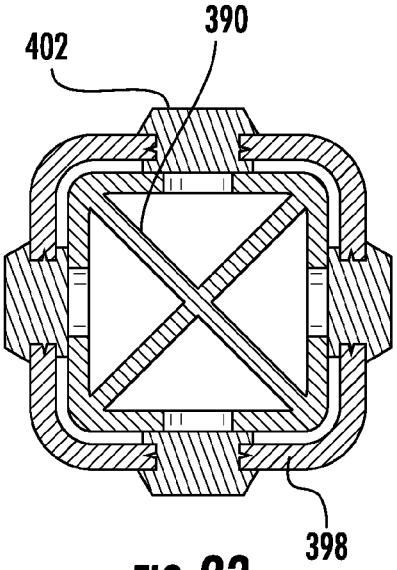
FIG. 23 is a cross sectional view of the spray tube and the collar structure of FIG. 22.

With reference to FIGS. 22 and 23, another embodiment of a barrel assembly 390 is shown that includes a collar structure 394 having a ring 398 and nozzle structures 402 connected thereto. Locking of the collar structure 394 to the barrel assembly 390 is accomplished via the shape of the elements.

Figure 24:
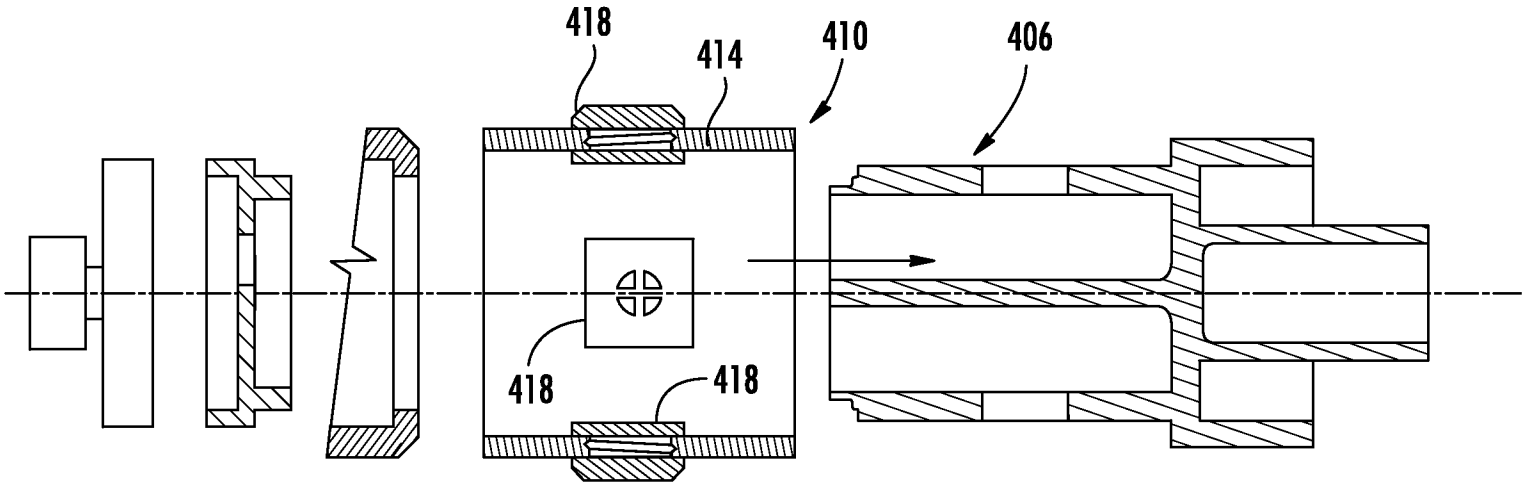
FIG. 24 is a perspective view of another embodiment of a water connection structure, a spray tube, and a collar structure for use with at least the water sprinkler of FIG. 18.

As shown in FIG. 24, another embodiment of a barrel assembly 406 is shown that includes a collar structure 410 having a ring 414 and a nozzle structures 418 connected thereto.

C. Rotatable Water Nozzle Structure

Figure 25:
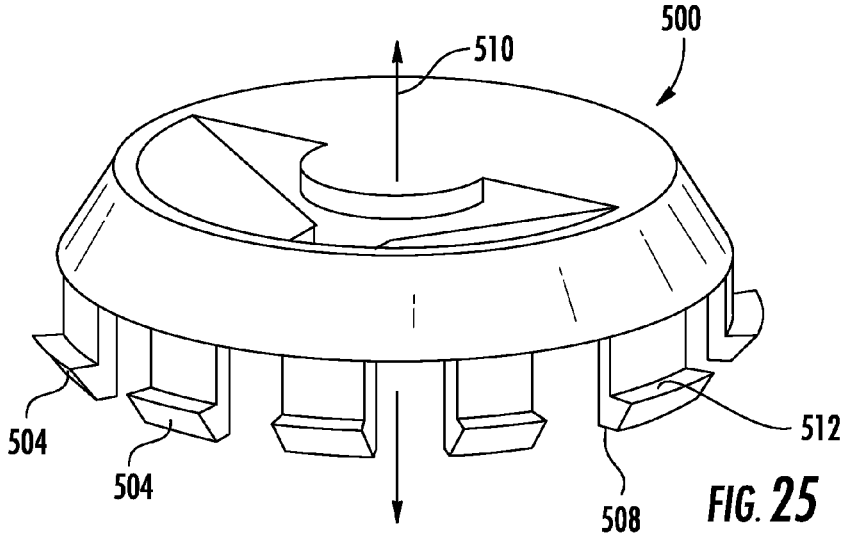
FIG. 25 is a perspective view of a nozzle structure for use with at least the water sprinkler of FIG. 1, the nozzle structure being configured for rotation relative to the spray tube of the water sprinkler.

As shown in FIG. 25, a circular nozzle structure 500 includes numerous resilient latching members 504 located around a circumference of the nozzle structure 500. The latching members 504 are spaced apart from each other and include an angled surface 508 and a ledge 512. The latching members 504 are configured to secure the nozzle structure 500 to an opening in a spray tube of a sprinkler, such as the fluid outlet 170 in the spray tube 10 of the sprinkler 100 of FIG. 2.

The angled surfaces 508 cause the latching members 504 to move toward an axial center 510 of the nozzle structure 500 as the nozzle structure 500 is being inserted into one of the fluid outlets 170. Once fully inserted into the fluid outlet 170 the latching members 504 "spring" back to the position shown in FIG. 25, and the ledges 512 contact an interior side (e.g. interior side 220, FIG. 12*b*) of the spray tube 10 to prevent removal of the nozzle structure 500 from the fluid outlet 170.

The nozzle structure 500 is configured to be rotatably mounted on the spray tube 10 of the barrel assembly, such that the nozzle structure is rotatable relative to the spray tube 10. The rotatable nozzle structure 500 enables a user to direct the water emitted from the nozzle structure to a particular location. The nozzle structure 500 is rotatable a full 360 degrees.

Figure 26A:
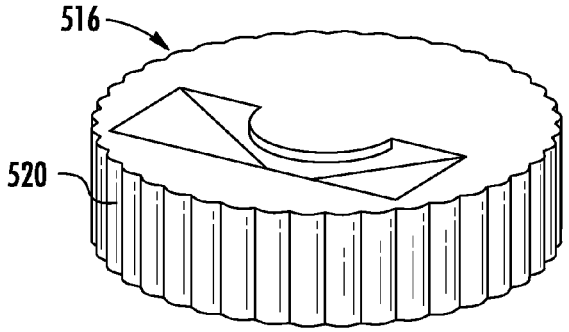
FIG. 26*a* is a perspective view of another nozzle structure for use with at least the water sprinkler of FIG. 1, the nozzle structure being configured for rotation relative to the spray tube of the water sprinkler.
Figure 26B:
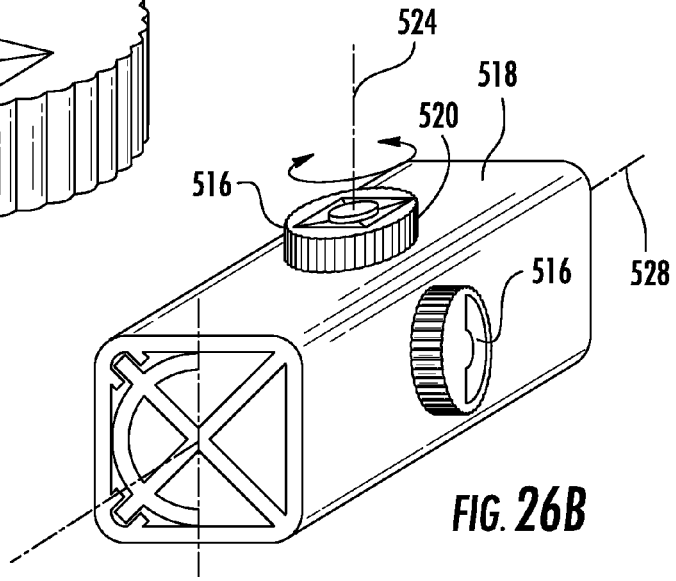
FIG. 26*b* is a perspective view of the nozzle structure of FIG. 26*a* connected to an exemplary spray tube and collar ring.

As shown in FIGS. 26*a* and 26*b*, another circular nozzle structure 516 is rotatably connected to a spray tube 518 of a sprinkler. The nozzle structure 516 includes a grip surface 520 configured to simplify rotating the nozzle structure 516 even when the nozzle structure and grip surface are wet. The nozzle structure 500 and the nozzle structure 516 are rotatable about an axis 524 that is perpendicular to or skewed to an axis 528 about which the spray tube 518 is rotatable.

Figure 26C:
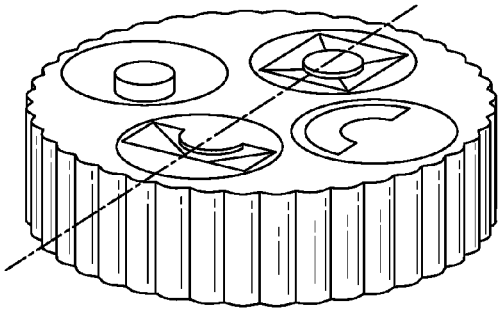
FIG. 26*c* is a perspective view of an exemplary turret including four water pattern nozzles each configured to emit a fluid in a different spray pattern.

The nozzle structures 500, 516 are rotatable to enable the output water stream to be positioned without having to move the base of the sprinkler, as is typical with known sprinklers (an example of which is shown in FIG. 26*c*).

Figure 27:
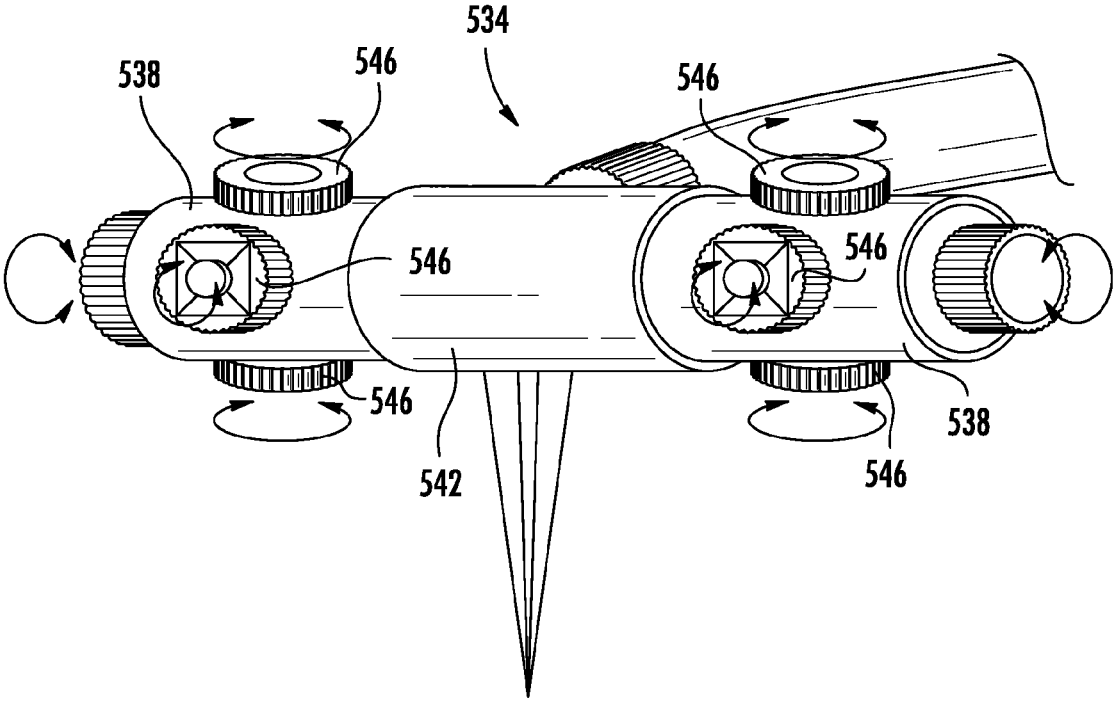
FIG. 27 is a perspective view of a water sprinkler (similar to the water sprinkler of FIG. 15A) that includes a plurality of the individually rotatable nozzle structures shown in FIG. 26*a;*

As shown in FIG. 27 another embodiment of the sprinkler 534 includes a barrel assembly 538 that is rotatably mounted to a water connection assembly 542. Each barrel assembly 538 includes four nozzle structures 546 (only three of which are shown), which are rotatably connected to the barrel assembly to enable the position of an output water stream to be easily controlled as shown in the illustrations below the sprinkler 534.

Figure 28:
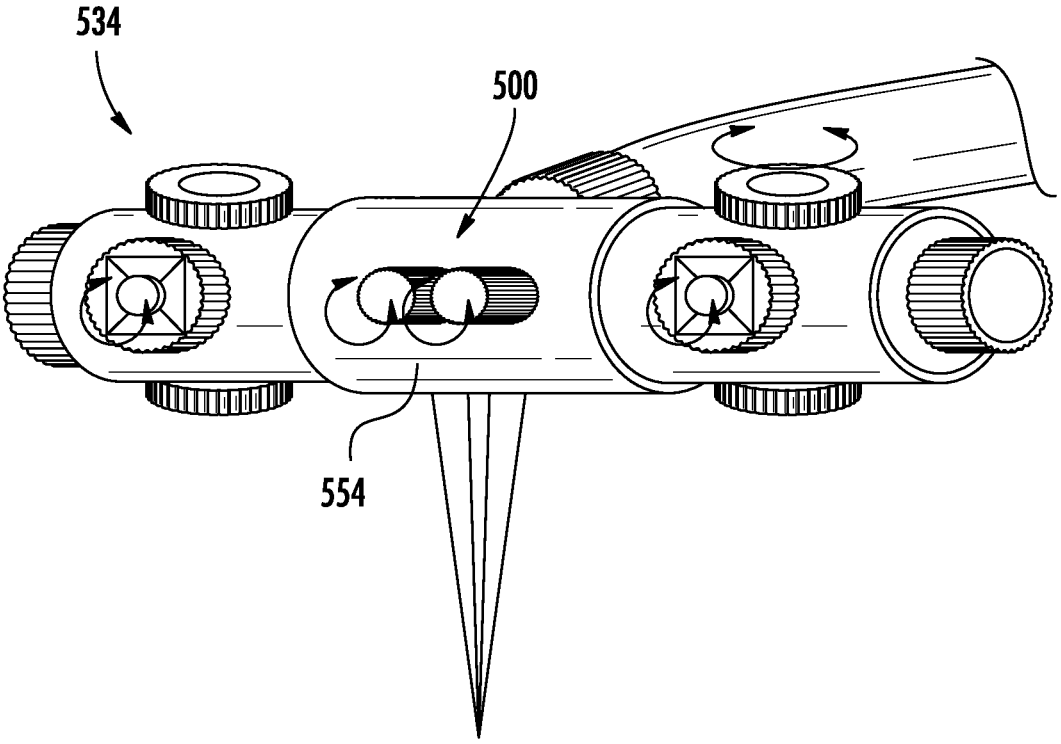
FIG. 28 is a perspective view of a water sprinkler (similar to the water sprinkler of FIG. 15A) that includes a plurality of the nozzle structures shown in FIG. 26*a* and a flow control system configured to control the amount of water that flows through the nozzle structures.
Figure 29A:
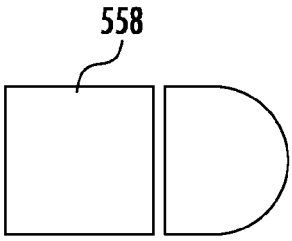
FIG. 29A is a block diagram view of a first exemplary water pattern attainable with flow control with at least the water sprinkler of FIG. 28.
Figure 29B:
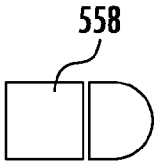
FIG. 29B is a block diagram view of a second exemplary water pattern attainable with flow control with at least the water sprinkler of FIG. 28.
Figure 29C:
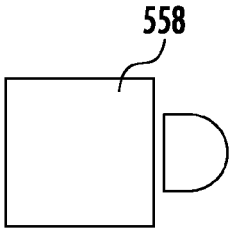
FIG. 29C is a block diagram view of a third exemplary water pattern attainable with flow control with at least the water sprinkler of FIG. 28.
Figure 29D:
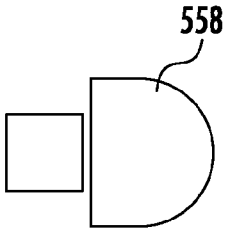
FIG. 29D is a block diagram view of a fourth exemplary water pattern attainable with flow control with at least the water sprinkler of FIG. 28.

In FIG. 28 the sprinkler 534 includes a flow control system 500 having adjustment knobs 554. By rotating the adjustment knobs 554 the amount of water output from the sprinkler 534 is controllable, as shown in the exemplary water patterns 558 of FIGS. 29A, 29B, 29C, and 29D, which includes pattern sizes and complex shapes.

In FIGS. 30*a*, 30*b*, 31A, 31B, and 31C other water emitting devices 562, 564, 566, 568, 570 are shown. The devices 562, 564, 568, and 570 each include a rotatable turret 574 that is used to select a water pattern structure 578.

Figure 30A:
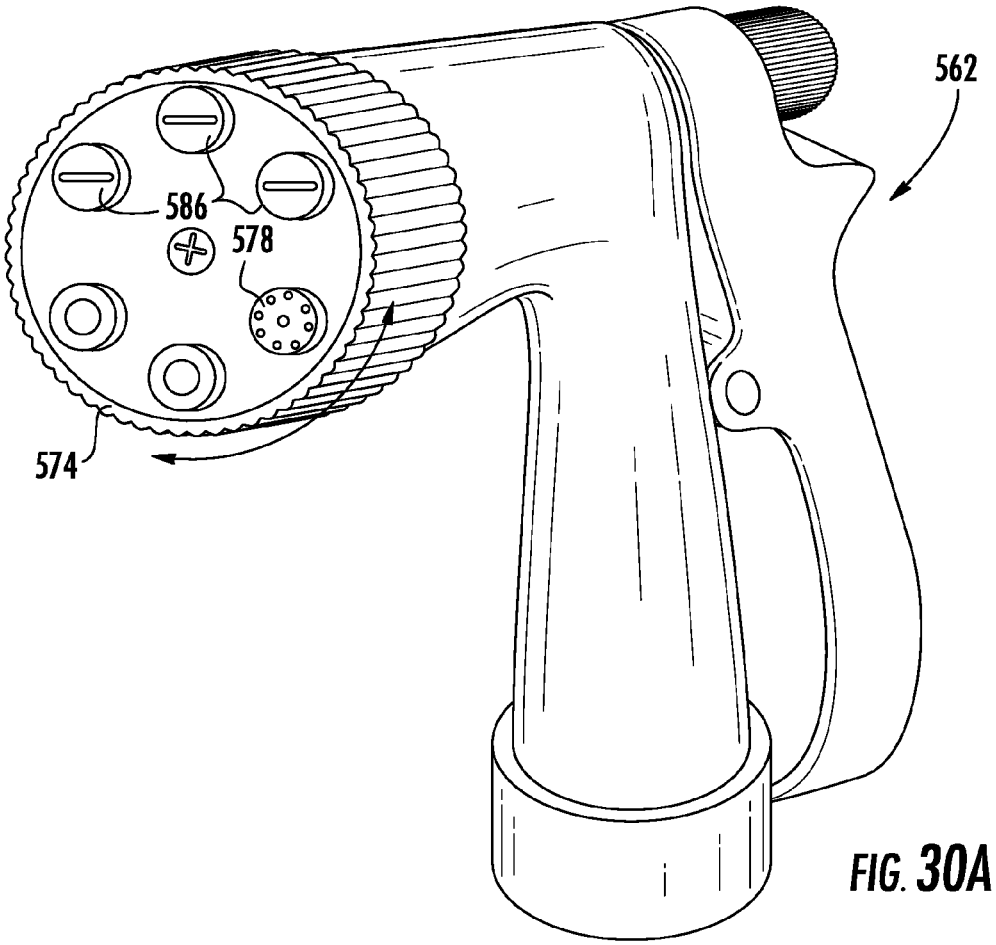
FIG. 30*a* is a perspective view of an exemplary pistol-shaped nozzle that includes a turret including numerous water pattern nozzles.
Figure 30B:
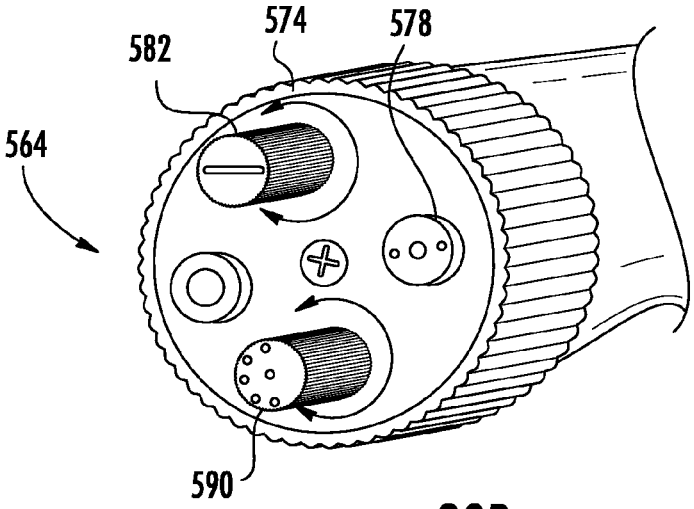
FIG. 30*b* is a perspective view of a turret for use with the pistol-shaped nozzle of FIG. 30*a* that includes a nozzle structure that is rotatable relative to the turret
Figure 31C:
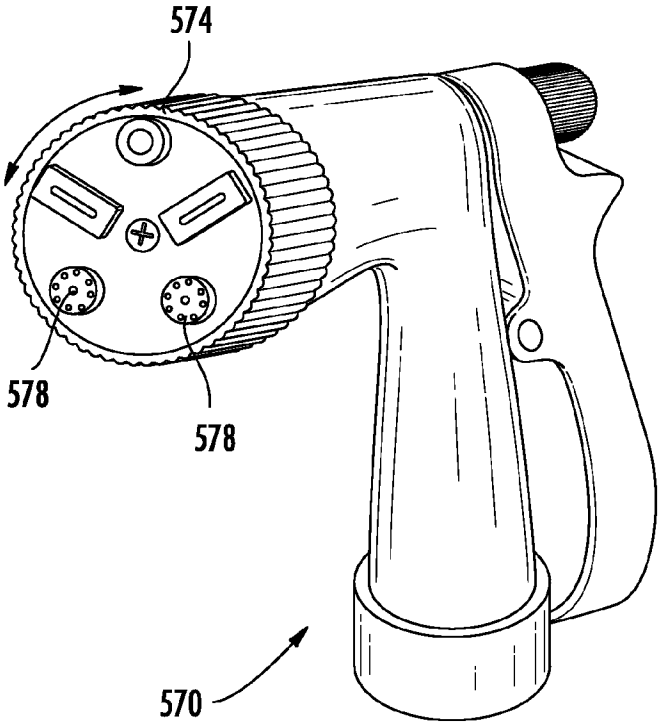
FIG. 31C is a perspective view of a pistol-shaped nozzle.
Figure 31B:
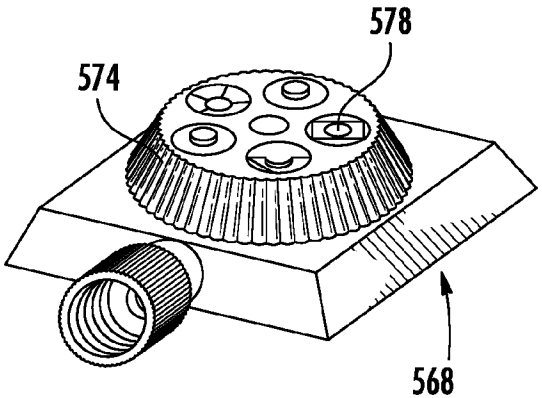
FIG. 31B is a perspective view of another water sprinkler.
Figure 31A:
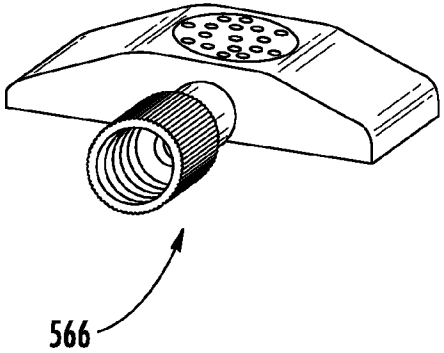
FIG. 31A is a perspective view of a water sprinkler.

The device 564 of FIG. 30*b* includes a nozzle structure 582 that is rotatable relative to the turret 574. The nozzle structure 582 eliminates the need for three separate water pattern structures 586, which each have the same shape but have a different angular position, as shown in FIG. 30*a*. The device 564 also includes another nozzle structure 590 that is rotatable relative to the turret 574. The device 564 offers an infinite number of pattern orientations and at the same has a smaller turret 574, which requires less material to manufacture and offers less shipping bulk. Additionally, more of the devices 564 are able to be hanged on a retail hook than the devices 562, for example.

D. Sliding Water Pattern Assembly

Figure 32:
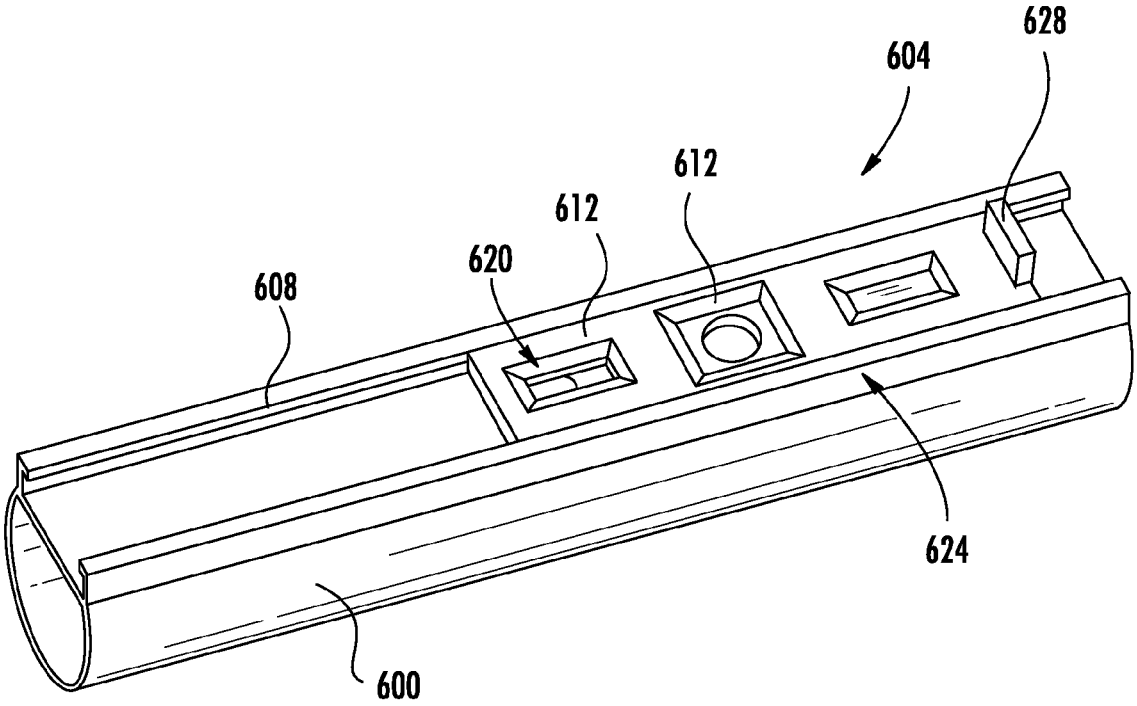
FIG. 32 is a perspective view of a spray tube and a sliding water pattern assembly.

As shown in FIGS. 32 and 33, a spray tube 600 includes a sliding nozzle assembly 604 sliding supported on a track structure 608 of the spray tube. The nozzle assembly 604 includes at least a first nozzle 612 (left side) and a second fluid nozzle 612 (right side). The nozzle assembly 604 is slidable in the track 608 relative to the spray tube 600 in a direction that is parallel a longitudinal axis 616 (FIG. 33) of the spray tube 600 to position a selected one of the fluid nozzles 612 in sealing engagement with the fluid outlet 620.

With reference to FIGS. 34*a*, 34*b*, and 34*c*, when one of the nozzle structures 612 is aligned with a fluid outlet 620 (FIG. 32) in the spray tube 600, that nozzle structure is configured to output a stream of water from the garden hose. The fluid outlet 620 is typically located in the center of the spray tube 600, as measured along the longitudinal axis 616. In another embodiment, the spray tube 600 includes more than one of the fluid outlet 620. Accordingly, in this embodiment, the spray tube 600 is configured to emit water from more than one of the nozzle structures 612 at a time.

With reference again to FIG. 32, in one embodiment, the nozzle structures 612 are connected to form a nozzle block 624 that is slidably positioned in the track 608. The nozzle block 624 includes a grip tab 628 to simplify sliding the nozzle block 624 in the track 608.

In FIGS. 35*a* and 35*c*, a seal solution 634 is shown that is configured to provide a water tight seal between the nozzle structure 612 that is to receive water and the spray tube 600. The seal solutions 634 include a seal member 638 supported by the fluid outlet 620 and configured to sealingly engage the selected nozzle structure 612 to form a water tight connection between the spray tube 600 and the selected nozzle structure 612.

In FIG. 35*b*, a seal solution 634 is shown that is configured to provide a water tight seal between the nozzle structure 612 that is to receive water and the spray tube 600. The seal solutions 634 include a seal member 638 supported by the nozzle structure 612 and configured to sealingly engage the fluid outlet 620 to form a water tight connection between the spray tube 600 and the selected nozzle structure 612.

Figure 36:
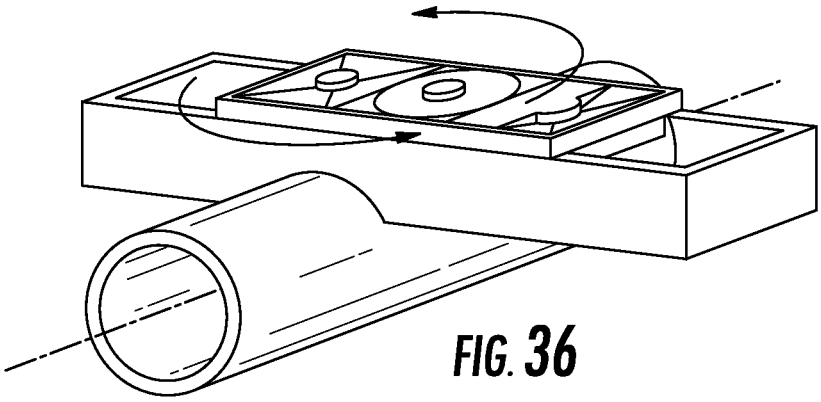
FIG. 36 is a perspective view of another embodiment of the spray tube and sliding water pattern assembly of FIG. 32.

As shown in FIG. 36, the track 608 is connected to the spray tube 600 in a perpendicular orientation to the longitudinal axis 616. In yet another embodiment, the track 608 is pivotally connected to the spray tube 600 to enable the track to be rotated a full 360 degrees about the spray tube.

The spray tube 600 including the sliding water pattern assembly 604 is usable with the sprinkler 100 of FIG. 1 and with the sprinkler 250 of FIG. 14. Accordingly, such a sprinkler includes a rotatable barrel assembly 108 and an associated sliding water pattern assembly 604.

E. Positioning Structure

Figure 37:
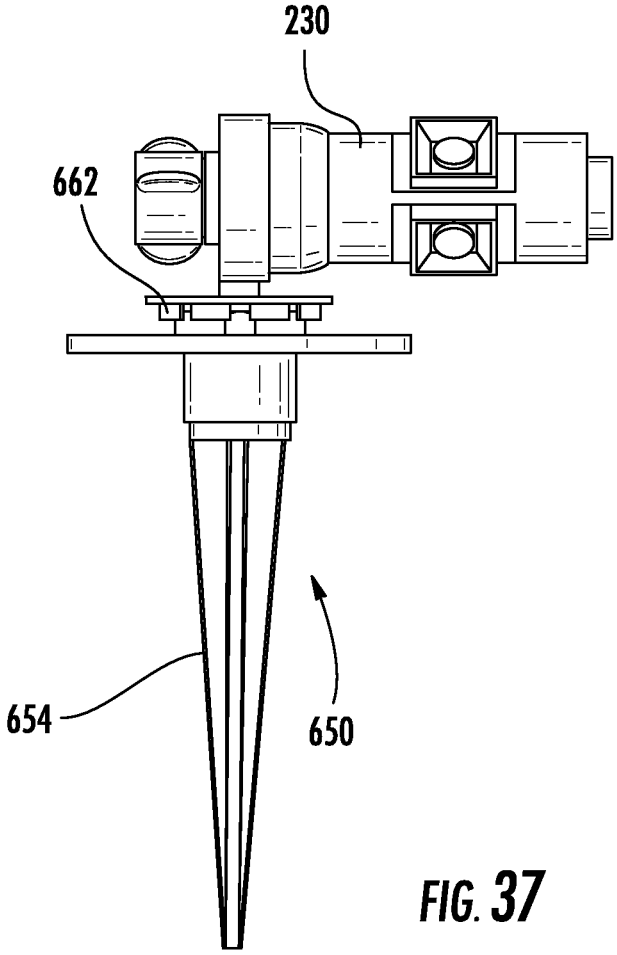
FIG. 37 is a side elevational view of the sprinkler of FIG. 13 including a spiked positioning fitting and connected to a positioning structure configured to be anchored in the ground.

As shown in FIG. 37, the water sprinkler 230 of FIG. 13 is releasably engaged to a semi-permanent spike assembly, which is referred to herein as a positioning structure 650. The positioning structure 650 includes an anchoring element 654, a positioning fitting 658 (FIG. 1), and a locking ring 662.

Figure 38:
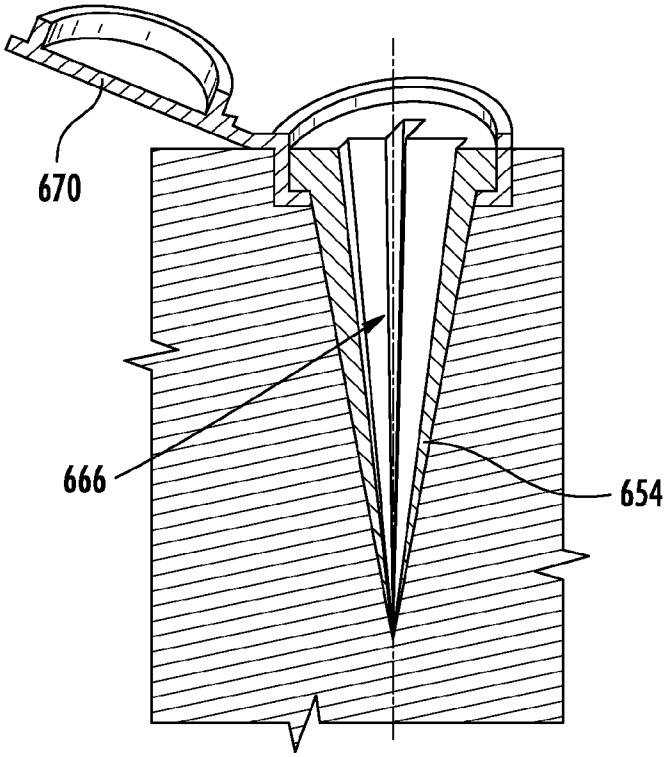
FIG. 38 is a perspective view a socket and cap of the positioning structure of FIG. 37.

As shown in FIG. 38, the anchoring element 654 is drawn to a point to enable the anchoring element to be easily inserted into the ground, even hard soils, thereby anchoring the positioning structure 650 and the water sprinkler 230 in the ground. The anchoring element 654 defines a socket 666 and includes a cap structure 670. The socket 666 has a shape that is configured to receive the positioning fitting 658 and to prevent rotation of the fitting within the socket. In particular, the positioning fitting 658 interlocks with the socket 666 to prevent rotation of the positioning fitting 658 relative to the positioning structure 650.

With continued reference to FIG. 38, the cap 670 is supported by the positioning structure 650 and is positionable in a covered position and an uncovered position. In the covered position the cap 670 is configured to close the socket 666 to prevent debris from entering the socket, and the socket is prevented from receiving the positioning fitting 658. In the uncovered position, the positioning fitting 658 is receivable by the socket 666.

Figure 39:
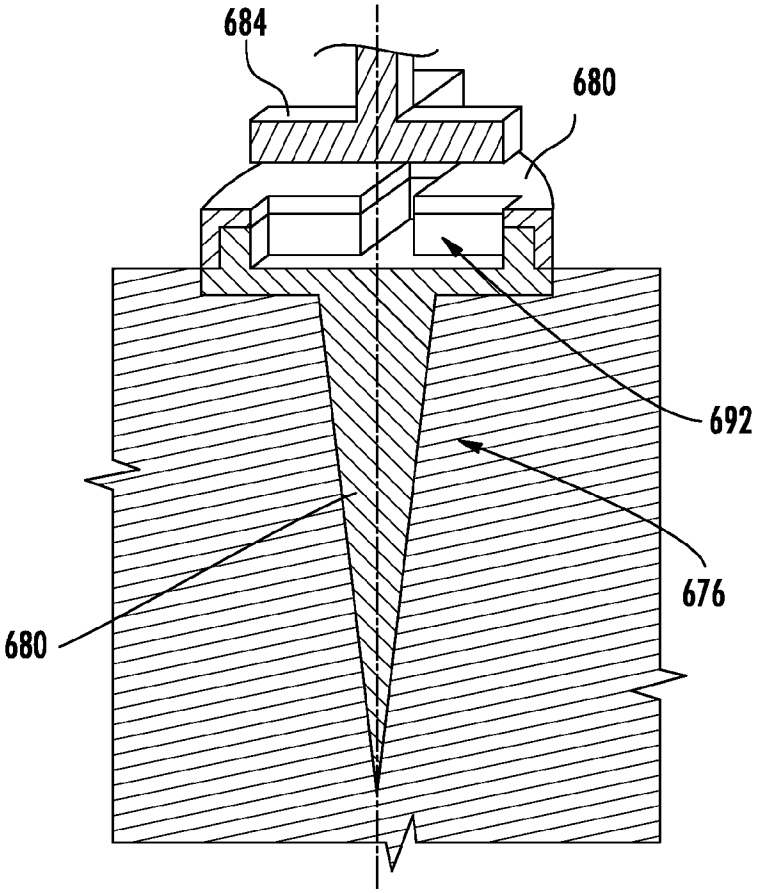
FIG. 39 is a perspective view of another embodiment of a positioning structure defining a socket and a locking ring.
Figure 40:
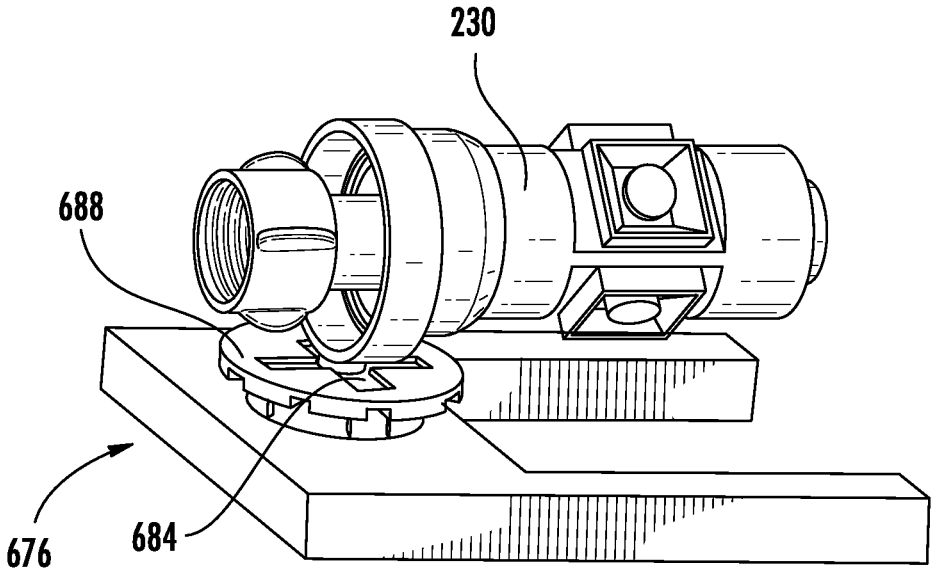
FIG. 40 is a perspective view of the sprinkler of FIG. 13 connected to another embodiment of a positioning structure configured to be anchored in the ground.

Another embodiment of the positioning structure 676 is shown in FIGS. 39 and 40 (partially shown in FIG. 40). The positioning structure 676 includes an anchoring element 680, a positioning fitting 684 that is connected to the sprinkler 230, and a locking ring 688.

As shown in FIG. 39, the anchoring element 680 is drawn to a point to enable the spike receptacle to be easily inserted into the ground, even hard soils. The anchoring element 680 defines a socket 692. The socket 692 has a shape that is configured to receive and to interlock with the positioning fitting 684 to prevent rotation of the positioning fitting within the socket. In particular, the positioning fitting 684 is receivable by the socket 692 in a selected one of four positions to enable the user to easily direct the flow of water in a selected one of four directions. In other embodiments, the positioning fitting 684 is receivable by the socket 692 in a selected one of between one to eight positions.

The locking ring 688 is rotatable relative to the anchoring element 680 to a locked position and an unlocked position. In the locked position, the locking ring 688 engages the positioning fitting 684 to prevent separation of the positioning fitting 684 from the socket 692. In the unlocked position, the locking ring 688 is disengaged from the positioning fitting 684 to enable separation of the positioning fitting 684 form the socket 692.

Figure 41:
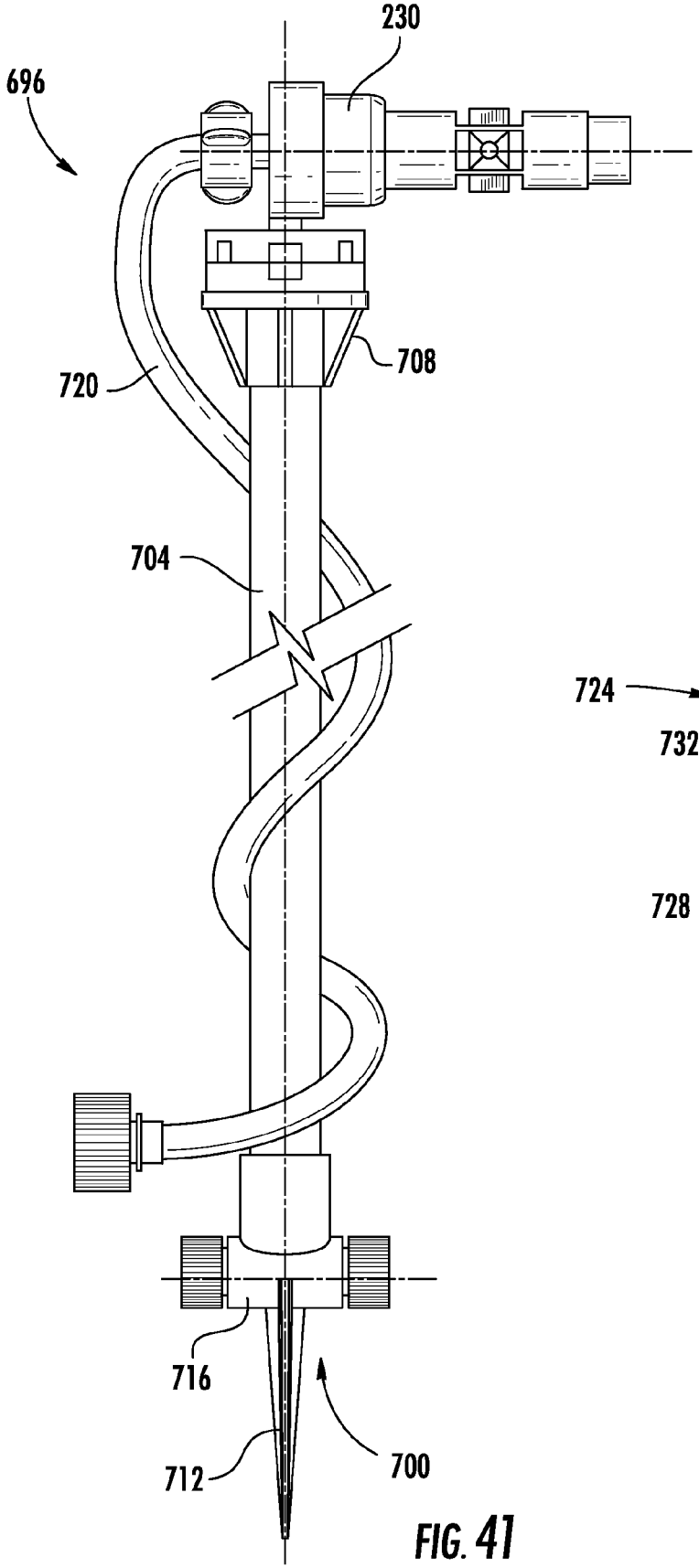
FIG. 41 is a side elevational view of the water sprinkler of FIG. 13 connected to another embodiment of a positioning structure that includes a riser tube and is configured to be anchored in the ground.

With reference to FIG. 41, another spike assembly 696 includes an in ground spike unit 700, a riser tube 704, and a connection assembly 708. The spike unit 700 is positionable in the ground and includes a spike 712 and at least one hose coupling 716. The spike 712 stabilizes the spike assembly 696 in the ground. The hose coupling 716 is connectable to a supply of water, such as a garden hose. The hose coupling 716 is serially connectable to additional hose couplings.

The riser tube 704 extends between the spike unit 700 and the connection assembly 708. The riser tube 704, in at least one embodiment, is a hollow tube that is fluidly coupled to the hose coupling 716, and is configured to supply the sprinkler 230 with water from the garden hose connected to the hose coupling.

The connection assembly 708 removably connects the sprinkler 230 to the riser tube 704. The connection assembly 708 is provided as any type of connection assembly configured to connect the sprinkler 230 to the riser tube 704.

As also shown in FIG. 41, instead of delivering water through a hollow riser tube 704, the spike assembly 696 is configurable to supply the sprinkler 230 with water from a coil hose 720.

Figure 42:
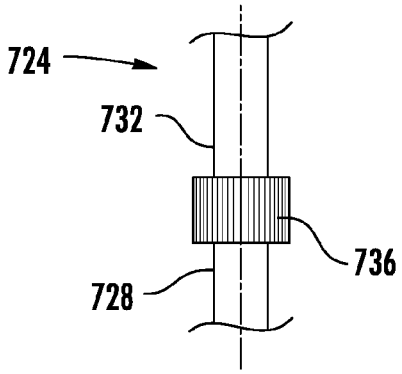
FIG. 42 is a side elevational view another embodiment of a positioning structure including a telescopically extendable riser tube.

As shown in FIG. 42, in some embodiments, the spike assembly 696 includes a riser tube 724 that is telescopically extendable and includes a lower riser tube 728 and an upper riser tube 732. A locking member 736 fixes the position of the upper riser tube 732 relative to the lower riser tube 728.

Use of the spike assembly 650, 676, 696 enables the user to easily place the sprinkler 230 in the same location and to point the sprinkler in same direction during each use. When the sprinkler 230 is removed from the spike assembly 650, 676, the spike assembly is low enough to enable a user to traverse the spike assembly with a lawn mower without contacting the spike assembly with the blade of the mower.

F. Nozzle Structure having Center Fill-In Fluid Outlet Opening

Figure 43:
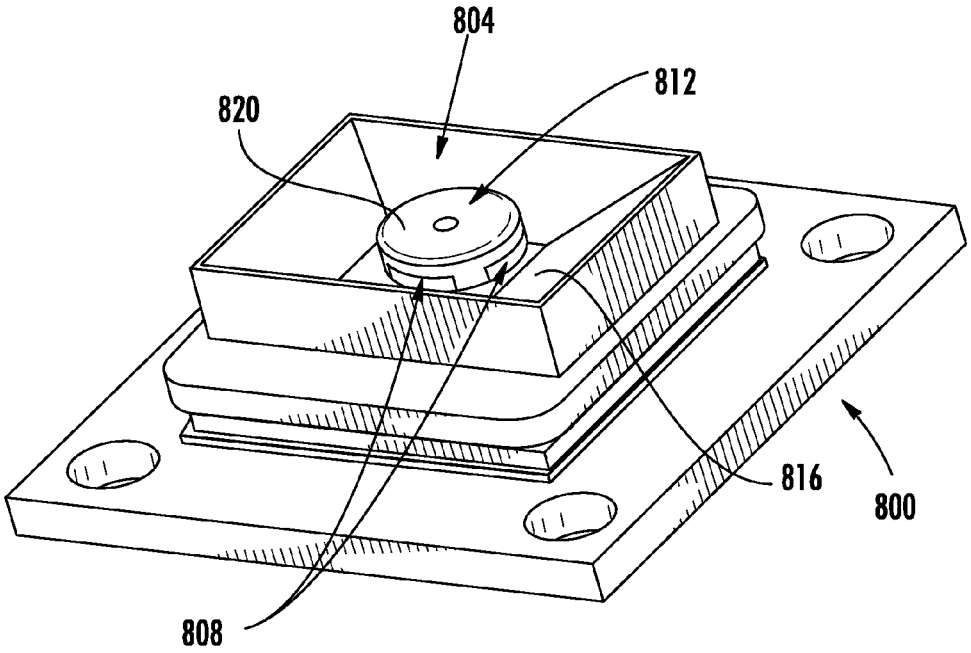
FIG. 43 is a perspective view of a nozzle structure for use with at least the water sprinkler of FIG. 1, the nozzle structure having a diffuser that includes a main water opening and a center through hole water opening.

As shown in FIG. 43, a fill-in nozzle structure 800 is configured to be fluidly coupled to the primary fluid inlet 122 of FIG. 2, for example. The nozzle structure 800 includes a diffuser 804 defining at least one main water passage 808 and at least one through hole passage 812. The main water passage 808, which is also referred to herein as a first outlet opening, is positioned between a base 816 and a top 820 of the diffuser 804. The through hole passage 812, which is also referred to herein as second outlet opening, is defined in approximately the center of the top 820 of the diffuser 804. The through hole passage 812 has a circular shape, a square shape, a cross shape, or any other shape as desired by those of ordinary skill in the art.

Figure 44:
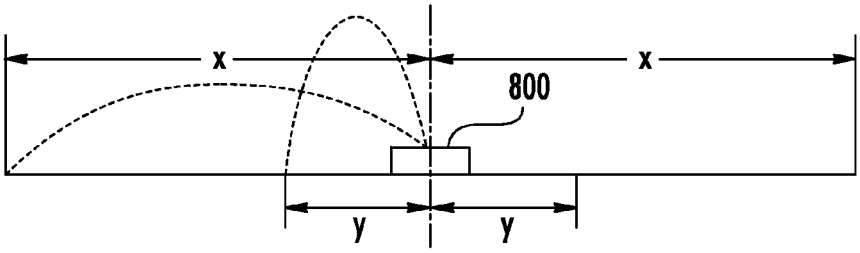
FIG. 44 is a side elevational view of the nozzle structure of FIG. 43 showing an exemplary area of coverage available from the nozzle structure.

With reference to FIG. 44, the main water passage 808 is configured to emit a fluid flow a first maximum distance X from the nozzle structure 800 and the base 17. Due to various elements, the water coverage available from the main water passage 808, during some situations, is non-uniform. Exemplary elements that affect the coverage available from the main water passage 808 include wind, surface finish of the diffuser 804, and others.

The through hole passage 812 is configured to direct a second flow of water in the area that is commonly underserved by the flow of water from the main water passage 808. In particular, the through hole passage 812 is configured to emit a second fluid flow a second maximum distance Y from the nozzle structure 800 and the base 17. In one embodiment, the second maximum distance Y is less than or equal to one third of the first maximum distance X. The nozzle structure 800 with the diffuser 804 having the main water passage 808 and the through hole 812 passage delivers complete coverage within the distance X from the base 17.

The nozzle structure 800 is usable with any sprinkler and any sprinkler embodiment or sprinkler configuration described herein.

G. Nozzle Structure having Three Quarter Opening Pattern

Figure 45:
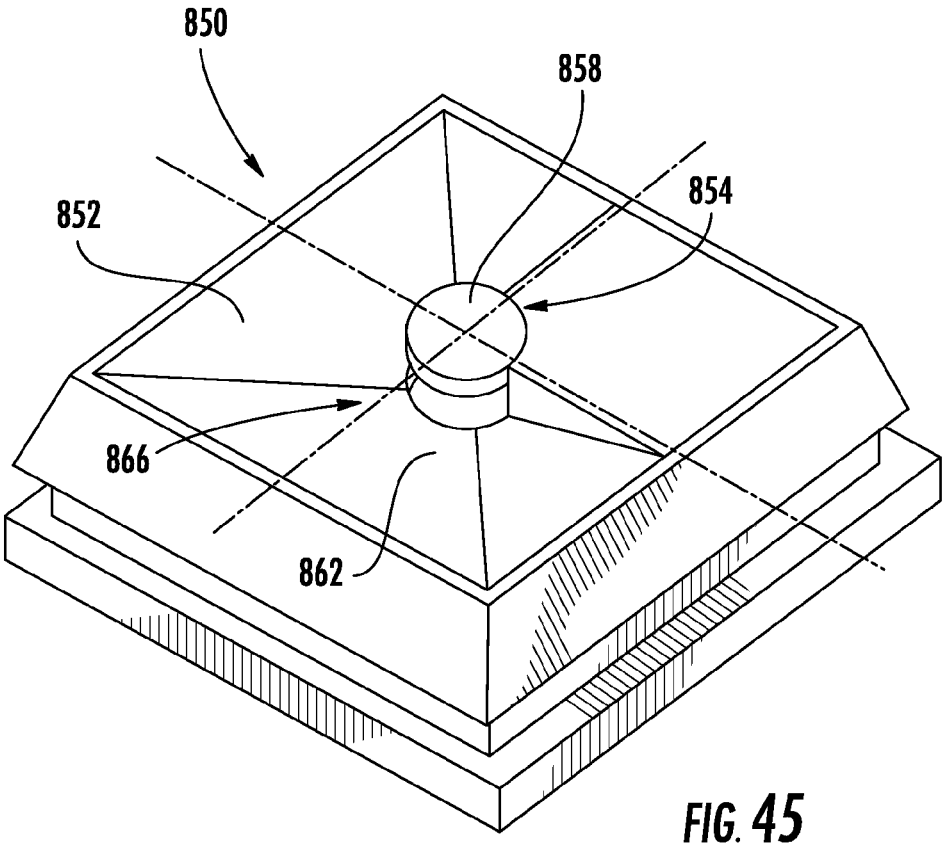
FIG. 45 is a perspective view of a nozzle structure for use with at least the water sprinkler of FIG. 1, the nozzle structure having a diffuser with a ¾ opening pattern.
Figure 46:
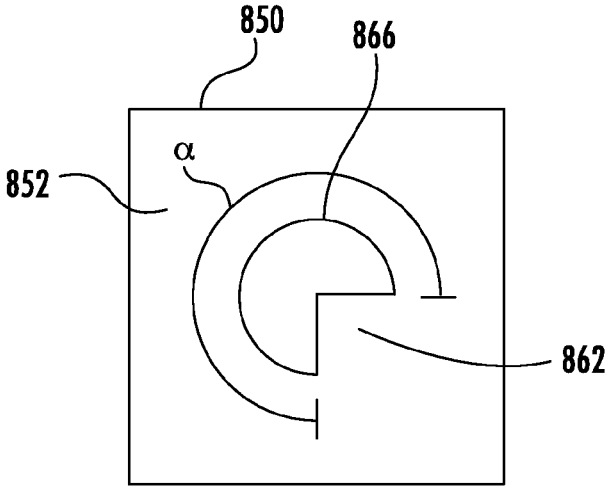
FIG. 46 is a top view of the nozzle structure of FIG. 45.

As shown in FIG. 45, an angular coverage nozzle structure 850 is configured to be fluidly coupled to the primary fluid inlet 122 of FIG. 2. The nozzle structure 850 includes a pattern depression 852 and a diffuser 854 that includes a top portion 858 and a bottom portion 862. The top portion 858 is spaced apart from the bottom portion 862 to define an outlet opening 866. With reference to FIG. 46, in which the top portion 858 is not shown, the outlet opening 866 is a three quarter opening pattern, as viewed from the top. The shape of the outlet opening 866 is three quarters ("¾") of any shape, such as a square, a rectangle, or a circle. In the exemplary nozzle structure 850 of FIGS. 45 and 46, the outlet opening 866 is approximately ¾ of a circle.

In use the nozzle structure 850 emits a fluid flow spanning an angle of coverage $\alpha$, which is approximately equal to 270 degrees. In other embodiments, the angle of coverage ranges from approximately 250° to 290°. Additionally, the resultant watering area is in the shape of the pattern depression 852, which in the embodiment of FIG. 45 is a square. Accordingly, the nozzle structure 850 is particularly useful when the sprinkler with which it is associated is positioned on an outside corner of a building, since the spray of water covers both the front and the side of the building, for example. In other embodiments, the pattern depression 852 is shaped as a circle, a rectangle, or any other shape, and is configured to produce a correspondingly shaped watering area.

The nozzle structure 800 is usable with any sprinkler and any sprinkler embodiment or sprinkler configuration described herein.

Any of the above-described sprinklers and nozzle structures are usable with both above-ground and in-ground irrigation systems.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A water sprinkler comprising:

a base;

a first sprinkler assembly comprising:

a first barrel assembly rotatably supported by the base and defining a plurality of first fluid channels, each first fluid channel extending from a fluid inlet to a fluid outlet;

a first primary fluid inlet supported by the base and configured to be selectively fluidly coupled to one of the first fluid channels by rotating the first barrel assembly to a position that aligns the fluid inlet of the selected first fluid channel with the first primary fluid inlet; and a plurality of first nozzle structures supported by the first barrel assembly, each first nozzle structure (i) configured to sealingly engage the fluid outlet of one of the plurality of first fluid channels, (ii) defining an outlet opening configured to emit a fluid flow, and (iii) rotatable relative to the first barrel assembly to alter a position of the fluid flow; and a second sprinkler assembly comprising:

a second barrel assembly rotatably supported by the base and defining a plurality of second fluid channels, each second fluid channel extending from a fluid inlet to a fluid outlet;

a second primary fluid inlet supported by the base and configured to be selectively fluidly coupled to one of the second fluid channels by rotating the second barrel assembly to a position that aligns the fluid inlet of the selected second fluid channel with the second primary fluid inlet; and a plurality of second nozzle structures supported by the second barrel assembly, each second nozzle structure (i) configured to sealingly engage the fluid outlet of one of the plurality of second fluid channels, (ii) defining an outlet opening configured to emit a fluid flow, and (iii) rotatable relative to the second barrel assembly to alter a position of the fluid flow.

2. The water sprinkler of claim 1, wherein at least one first nozzle structure is rotatably mounted on the first barrel assembly.

3. The water sprinkler of claim 2, wherein at least one second nozzle structure is rotatably mounted on the second barrel assembly.

4. The water sprinkler of claim 1, wherein:

the first barrel assembly includes an elongated cylinder extending in a first longitudinal direction, and the first barrel assembly is configured to rotate about an axis defined by the first longitudinal direction.

5. The water sprinkler of claim 4, wherein:

the second barrel assembly includes an elongated cylinder extending in a second longitudinal direction, and the second barrel assembly is configured to rotate about an axis defined by the second longitudinal direction.

6. The water sprinkler of claim 1, wherein the first sprinkler assembly further comprises:

a first faceplate defining a plurality of first detent seats, each first detent seat corresponding to one of the first fluid channels;

a first detent button; and a first biasing member configured to bias the first detent button at least partially into a selected detent seat of the plurality of first detent seats to maintain the first barrel assembly in the position that aligns the fluid inlet of the selected first fluid channel with the first primary fluid inlet.

7. The water sprinkler of claim 6, wherein the second sprinkler assembly further comprises:

a second faceplate defining a plurality of second detent seats, each second detent seat corresponding to one of the second fluid channels;

a second detent button;

a second biasing member configured to bias the second detent button at least partially into a selected detent seat of the plurality of second detent seats to maintain the second barrel assembly in the position that aligns the fluid inlet of the selected second fluid channel with the second primary fluid inlet.

8. The water sprinkler of claim 1, wherein the first sprinkler assembly further comprises a first knob connected to the first barrel assembly to enable a user to rotate to the first barrel assembly, and wherein the second sprinkler assembly further comprises a second knob connected to the second barrel assembly to enable a user to rotate to the second barrel assembly.

9. The water sprinkler of claim 1, wherein each of the plurality of first nozzle structures are configured to emit a fluid flow in a different water pattern.

10. The water sprinkler of claim 9, wherein each of the plurality of second nozzle structures are configured to emit a fluid flow in a different water pattern.

11. The water sprinkler of claim 1, wherein the plurality of first nozzle structures comprises four first nozzle structures and the plurality of second nozzle structures comprises four second nozzle structures.

12. The water sprinkler of claim 11, wherein the first first nozzle structure is configured to emit a fluid flow in a square water pattern, the second first nozzle structure is configured to emit a fluid flow in a circle water pattern, the third first nozzle structure is configured to emit a fluid flow in a rectangle water pattern, and the fourth first nozzle structure is configured to emit a fluid flow in a semi-circle water pattern, and wherein the first second nozzle structure is configured to emit a fluid flow in a square water pattern, the second second nozzle structure is configured to emit a fluid flow in a circle water pattern, the third second nozzle structure is configured to emit a fluid flow in a rectangle water pattern, and the fourth second nozzle structure is configured to emit a fluid flow in a semi-circle water pattern.

13. The water sprinkler of claim 1, further comprising:

a flow control system including a first knob for controlling an amount of water output by the first sprinkler assembly and a second knob for controlling an amount of water output by the second sprinkler assembly.

14. A water sprinkler comprising:

a base;

a plurality of sprinkler assemblies, each sprinkler assembly comprising:

a barrel assembly rotatably supported by the base and defining a plurality of fluid channels, each fluid channel extending from a fluid inlet to a fluid outlet;

a primary fluid inlet supported by the base and configured to be selectively fluidly coupled to one of the first fluid channels by rotating the first barrel assembly to a position that aligns the fluid inlet of the selected first fluid channel with the first primary fluid inlet; and a plurality of first nozzle structures supported by the first barrel assembly, each first nozzle structure (i) configured to sealingly engage the fluid outlet of one of the plurality of first fluid channels, (ii) defining an outlet opening configured to emit a fluid flow, and (iii) each of the plurality of nozzles rotatable relative to the barrel assembly to produce a different water pattern.

15. The water sprinkler of claim 14, wherein each sprinkler assembly further comprises:

a faceplate defining a plurality of detent seats, each detent seat corresponding to one of the fluid channels;

a detent button;

a biasing member configured to bias the detent button at least partially into a selected detent seat of the plurality of detent seats to maintain the barrel assembly in the position that aligns the fluid inlet of the selected second fluid channel with the primary fluid inlet.

16. The water sprinkler of claim 14, wherein each sprinkler assembly further comprises:

a knob connected to the barrel assembly to enable a user to rotate to the barrel assembly.

17. The water sprinkler of claim 14, wherein for each of the plurality of water sprinkler assemblies, each of the plurality of nozzle structures are configured to emit a fluid flow in a different water pattern.

18. The water sprinkler of claim 14, wherein for each of the plurality of water sprinkler assemblies, the plurality of nozzle structures comprises four nozzle structures.

19. The water sprinkler of claim 18, wherein for each of the plurality of water sprinkler assemblies, the first first nozzle structure is configured to emit a fluid flow in a square water pattern, the second first nozzle structure is configured to emit a fluid flow in a circle water pattern, the third first nozzle structure is configured to emit a fluid flow in a rectangle water pattern, and the fourth first nozzle structure is configured to emit a fluid flow in a semi-circle water pattern.

20. The water sprinkler of claim 14, wherein each sprinkler assembly further comprises:

a flow control system including a knob for controlling an amount of water output by the sprinkler assembly.

* * * * *